US009060546B2

(12) United States Patent
Li et al.

(10) Patent No.: US 9,060,546 B2
(45) Date of Patent: Jun. 23, 2015

(54) SMOKING ARTICLE WITH A RESTRICTOR

(75) Inventors: San Li, Midlothian, VA (US); Raquel Olegario, Richmond, VA (US); Mike Braunshteyn, Richmond, VA (US); Rowland W. Dwyer, Richmond, VA (US); Martin Garthaffner, Chesterfield, VA (US); Dwight Williams, Powatan, VA (US); Richard Jupe, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 12/987,786

(22) Filed: Jan. 10, 2011

(65) Prior Publication Data

US 2011/0100388 A1 May 5, 2011

Related U.S. Application Data

(62) Division of application No. 11/727,825, filed on Mar. 28, 2007, now Pat. No. 7,878,963.

(60) Provisional application No. 60/786,352, filed on Mar. 28, 2006, provisional application No. 60/858,407, filed on Nov. 13, 2006, provisional application No. 60/905,833, filed on Mar. 9, 2007.

(51) Int. Cl.
*A24D 3/04* (2006.01)

(52) U.S. Cl.
CPC ..... *A24D 3/043* (2013.01); *A24D 3/045* (2013.01)

(58) Field of Classification Search
CPC . A24D 3/0283; A24D 3/0287; A24D 3/0291; A24D 3/0279; A24D 3/04; A24D 3/043; A24D 3/045
See application file for complete search history.

(56) References Cited

U.S. PATENT DOCUMENTS

| | | | |
|---|---|---|---|
| 2,511,898 | A | 6/1950 | Brothers |
| 2,547,119 | A | 4/1951 | Henderson |
| 2,592,553 | A | 4/1952 | Frankenburg et al. |
| 2,592,554 | A | 4/1952 | Frankenburg |
| 2,598,680 | A | 6/1952 | Frankenburg |
| 2,764,513 | A | 9/1956 | Brothers |
| 2,769,734 | A | 11/1956 | Bandel |
| 2,954,772 | A | 10/1960 | Lebert |
| 2,954,778 | A | 10/1960 | Lebert |

(Continued)

FOREIGN PATENT DOCUMENTS

| | | | |
|---|---|---|---|
| BE | 679657 | A | 10/1966 |
| BE | 1000454 | A4 | 12/1988 |

(Continued)

OTHER PUBLICATIONS

RJR, "HV—(High Ventilation)", 1994: Accessed via legacy.library.ucsf.edu/tid/sxm33d00 added to UCSF Feb. 1, 2002.*

(Continued)

*Primary Examiner* — Michael J Felton
(74) *Attorney, Agent, or Firm* — Buchanan Ingersoll & Rooney PC

(57) ABSTRACT

A smoking article filter includes a flow restrictor and a cavity downstream of the flow restrictor. The flow restrictor includes an orifice or flow channel for directing smoke into the cavity. The filter is attached to the tobacco rod with tipping paper and includes an air-admissible ventilating zone at a location downstream of the restrictor.

7 Claims, 18 Drawing Sheets

(56) References Cited

U.S. PATENT DOCUMENTS 2,954,783 A 10/1960 Lebert
2,954,786 A 10/1960 Lebert
2,979,058 A * 4/1961 Schur ..... 131/331
3,098,492 A 7/1963 Wurzburg et al.
3,234,949 A 2/1966 White et al.
3,236,244 A 2/1966 Irby, Jr. et al.
3,255,760 A 6/1966 Selke
3,283,762 A 11/1966 Kissel
3,292,635 A 12/1966 Kolodny
3,318,312 A 5/1967 Curtis, Jr.
3,323,525 A 6/1967 Miller
3,356,094 A 12/1967 Ellis et al.
3,389,705 A 6/1968 Levavi
3,395,713 A 8/1968 Ent-Keller
3,441,028 A 4/1969 Wall
3,457,927 A 7/1969 Siragusa
3,496,945 A 2/1970 Tomkin
3,504,677 A 4/1970 Doppelt
3,581,748 A 6/1971 Cameron
3,599,646 A 8/1971 Berger et al.
3,630,210 A 12/1971 Haslam
3,637,447 A 1/1972 Berger et al.
3,638,661 A 2/1972 Pinkham
3,646,941 A 3/1972 Doppelt
3,648,712 A 3/1972 Patterson
3,685,522 A 8/1972 Kleinhans
3,738,375 A 6/1973 Doumas
3,756,249 A 9/1973 Selke et al.
3,759,270 A 9/1973 Wright
3,860,011 A 1/1975 Norman
3,877,470 A 4/1975 Jewett et al.
3,931,824 A 1/1976 Miano et al.
3,968,804 A 7/1976 Kelly et al.
3,986,515 A 10/1976 Egri
4,016,887 A 4/1977 Uroshevich
4,022,222 A 5/1977 Berger
4,038,994 A 8/1977 Aikman
4,091,821 A 5/1978 Scorzo
4,119,105 A 10/1978 Owens, Jr.
4,120,310 A 10/1978 Lee et al.
4,135,523 A 1/1979 Luke et al.
4,158,364 A 6/1979 Ligeti
4,182,349 A 1/1980 Selke
4,186,756 A 2/1980 Takemoto et al.
4,197,863 A 4/1980 Clayton et al.
4,256,122 A 3/1981 Johnson
4,256,126 A 3/1981 Seligman et al.
4,273,141 A * 6/1981 Jan Van Tilburg ..... 131/336
4,292,983 A 10/1981 Mensik
4,340,072 A 7/1982 Bolt et al.
4,341,228 A 7/1982 Keritsis et al.
4,343,319 A 8/1982 Cantrell
4,357,950 A 11/1982 Berger
4,380,241 A 4/1983 Horsewell
4,386,618 A 6/1983 Cantrell
4,421,126 A 12/1983 Gellatly
4,460,001 A 7/1984 Browne et al.
4,469,112 A 9/1984 Browne et al.
4,506,683 A 3/1985 Cantrell et al.
4,508,525 A 4/1985 Berger
4,515,170 A 5/1985 Cantrell et al.
4,542,755 A 9/1985 Selke et al.
4,559,955 A 12/1985 Brockway et al.
4,564,030 A 1/1986 Jessup et al.
4,574,820 A 3/1986 Pinkerton et al.
4,585,015 A 4/1986 Silberstein
4,617,946 A 10/1986 Keith
4,620,553 A * 11/1986 Bale et al. ..... 131/198.1
4,622,982 A 11/1986 Gaisch et al.
4,637,409 A 1/1987 Berger
4,646,762 A 3/1987 Riehl et al.
4,649,944 A 3/1987 Houck, Jr. et al.
4,660,579 A 4/1987 Horsewell et al.
4,677,992 A 7/1987 Bliznak
4,687,008 A 8/1987 Houck, Jr. et al.
4,700,726 A 10/1987 Townsend et al.
4,702,263 A 10/1987 Strydom
4,732,168 A 3/1988 Resce et al.
4,754,766 A 7/1988 Luke et al.
4,784,632 A 11/1988 Berger
4,791,943 A 12/1988 Kupper et al.
4,793,365 A 12/1988 Sensabaugh, Jr. et al.
4,867,182 A 9/1989 Roberts et al.
4,896,682 A 1/1990 Liew
4,924,886 A 5/1990 Litzinger
4,942,887 A 7/1990 Abdelgawad et al.
4,949,736 A 8/1990 Roberts et al.
4,962,774 A 10/1990 Thomasson et al.
4,972,853 A 11/1990 Brackmann et al.
4,972,854 A 11/1990 Kiernan et al.
4,984,588 A 1/1991 Stewart, Jr.
5,046,514 A 9/1991 Bolt
5,050,621 A 9/1991 Creighton et al.
5,058,608 A 10/1991 Henning et al.
5,060,676 A 10/1991 Hearn et al.
5,074,319 A 12/1991 White et al.
5,099,864 A 3/1992 Young et al.
5,101,839 A 4/1992 Jakob et al.
5,105,836 A 4/1992 Gentry et al.
5,105,838 A 4/1992 White et al.
5,129,408 A 7/1992 Jakob et al.
5,152,304 A 10/1992 Bokelman et al.
5,178,166 A 1/1993 Newsome et al.
5,190,061 A 3/1993 Brackmann et al.
5,203,354 A 4/1993 Hickle
5,360,023 A 11/1994 Blakley et al.
5,392,792 A 2/1995 Banerjee et al.
5,392,793 A 2/1995 Molloy
5,435,326 A 7/1995 Gentry et al.
5,458,107 A 10/1995 Balogh et al.
5,524,647 A 6/1996 Brackmann
5,533,530 A 7/1996 Young et al.
5,568,819 A 10/1996 Gentry et al.
5,584,306 A 12/1996 Beauman et al.
5,598,868 A 2/1997 Jakob et al.
5,666,976 A 9/1997 Adams et al.
5,690,127 A 11/1997 Chapman et al.
5,709,227 A 1/1998 Arzonico et al.
5,715,844 A 2/1998 Young et al.
5,724,998 A 3/1998 Gellatly et al.
5,727,571 A 3/1998 Meiring et al.
5,743,251 A 4/1998 Howell et al.
5,746,230 A 5/1998 Arterbery et al.
5,839,449 A 11/1998 Banerjee et al.
5,954,061 A 9/1999 Cardarelli
5,979,459 A 11/1999 Schneider
6,062,228 A 5/2000 Loercks et al.
6,089,238 A 7/2000 Schneider et al.
6,216,706 B1 4/2001 Kumar et al.
6,257,242 B1 7/2001 Stavridis
6,345,625 B1 2/2002 Chew
6,502,580 B1 1/2003 Luparini
6,718,989 B1 4/2004 Clarke et al.
6,742,525 B2 6/2004 Sinclair, Jr.
6,761,174 B2 7/2004 Jupe et al.
6,761,176 B2 7/2004 Yoo
6,779,529 B2 8/2004 Figlar et al.
6,814,786 B1 11/2004 Zhuang et al.
6,823,873 B2 11/2004 Nichols et al.
6,883,516 B2 4/2005 Hindle et al.
6,883,523 B2 4/2005 Dante
7,240,678 B2 7/2007 Crooks et al.
7,552,735 B2 6/2009 Xue et al.
7,836,895 B2 11/2010 Dube et al.
7,914,622 B2 3/2011 Xue et al.
7,987,856 B2 8/2011 Gedevanishvili et al.
8,109,277 B2 2/2012 Li et al.
8,235,056 B2 8/2012 Zhuang et al.
8,235,057 B2 8/2012 Li et al.
8,240,315 B2 8/2012 Olegario et al.
8,353,298 B2 1/2013 Braunshteyn et al.
8,353,302 B2 1/2013 Olegario et al.
8,424,539 B2 4/2013 Braunshteyn et al.
8,424,540 B2 4/2013 Olegario et al.

(56) References Cited

U.S. PATENT DOCUMENTS

| | | | |
|---|---|---|---|
| 8,539,957 | B2 | 9/2013 | Zhang et al. |
| 2004/0025890 | A1 | 2/2004 | Yen |
| 2007/0261706 | A1 | 11/2007 | Banerjea et al. |
| 2008/0047571 | A1 | 2/2008 | Braunshteyn et al. |
| 2008/0216850 | A1 | 9/2008 | Li et al. |
| 2010/0288293 | A1 | 11/2010 | Slasli et al. |

FOREIGN PATENT DOCUMENTS

| | | | |
|---|---|---|---|
| DE | 3439861 | A1 | 5/1985 |
| EP | 0 054 705 | A1 | 6/1982 |
| EP | 0077123 | A2 | 4/1983 |
| EP | 0101840 | A | 3/1984 |
| EP | 0212879 | A1 | 4/1987 |
| EP | 0 327 655 | A1 | 8/1989 |
| EP | 0364256 | A1 | 4/1990 |
| EP | 0471581 | A1 | 2/1992 |
| EP | 0482872 | A1 | 4/1992 |
| EP | 0568107 | A | 11/1993 |
| EP | 0 481596 | B1 | 1/1994 |
| FR | 2481581 | | 11/1981 |
| FR | 2873899 | A | 2/2006 |
| GB | 1058342 | A | 2/1967 |
| GB | 1228747 | A | 4/1971 |
| GB | 1236344 | A | 6/1971 |
| GB | 1245518 | A | 9/1971 |
| GB | 1256154 | A | 12/1971 |
| GB | 1428018 | | 3/1976 |
| GB | 2100573 | A | 1/1983 |
| GB | 2149287 | A | 6/1985 |
| GB | 2177890 | A | 2/1987 |
| NZ | 19697 | | 11/1983 |
| NZ | 216244 | | 9/1989 |
| WO | WO 90/09741 | A | 9/1990 |
| WO | WO 99/26495 | A | 6/1999 |
| WO | WO 0000047 | A1 | 1/2000 |
| WO | WO 01/13745 | A1 | 3/2001 |
| WO | WO 02/03819 | A | 1/2002 |
| WO | WO 2006/070289 | A | 7/2006 |
| WO | WO 2006/082529 | A | 8/2006 |
| WO | WO 2007/093757 | A1 | 8/2007 |
| WO | WO 2007/110650 | A1 | 10/2007 |

OTHER PUBLICATIONS

RJ Reynolds, "High Ventilation Technology", 1993: Accessed via legacy.library.ucsf.edu/tid/ckl38c00 added to UCSF Apr. 15, 2003.*

International Preliminary Report on Patentability for PCT/IB2007/002869, dated Jan. 13, 2009.

International Preliminary Report on Patentability for PCT/IB2008/001382, dated Sep. 15, 2009.

International Preliminary Report on Patentability for PCT/GB2007/001144, dated Sep. 30, 2008.

International Preliminary Report on Patentability for PCT/IB2006/004202, dated Jul. 10, 2008.

International Preliminary Report on Patentability for PCT/IB2006/004209, dated Jul. 10, 2008.

International Preliminary Report on Patentability for PCT/IB2007/004503, dated Jul. 9, 2009.

International Preliminary Report on Patentability for PCT/IB2007/002910, dated Jan. 13, 2009.

International Preliminary Report on Patentability for PCT/IB2007/003165, dated Feb. 10, 2009.

International Preliminary Report on Patentability for PCT/IB2008/001372, dated Sep. 24, 2009.

International Preliminary Report on Patentability for PCT/IB2008/001383, dated Sep. 15, 2009.

International Preliminary Report on Patentability for PCT/IB2008/001348, dated Sep. 15, 2009.

International Preliminary Report on Patentability for PCT/IB2007/004224, dated May 19, 2009.

International Search Report and Written Opinion for PCT/IB2007/002869, dated Jan. 25, 2008.

International Search Report and Written Opinion for PCT/GB2007/001144, dated Jul. 7, 2007.

International Search Report and Written Opinion for PCT/IB2006/004209, dated Mar. 17, 2008.

International Search Report and Written Opinion for PCT/IB2007/004224, dated Jun. 13, 2008.

International Search Report and Written Opinion for PCT/IB2007/004503, dated Sep. 19, 2008.

International Search Report and Written Opinion for PCT/IB2007/002910, dated Jan. 24, 2008.

International Search Report and Written Opinion for PCT/IB2007/003165, dated Mar. 26, 2008.

International Search Report and Written Opinion for PCT/IB2008/001372, dated Nov. 3, 2008.

International Search Report and Written Opinion for PCT/IB2008/001383, dated Feb. 24, 2009.

International Search Report and Written Opinion for PCT/IB2008/001348, dated Jan. 27, 2009.

International Search Report and Written Opinion for PCT/IB2008/001382, dated Oct. 7, 2008.

International Search Report for PCT/EP2010/003016, dated Sep. 13, 2010.

International Search Report for PCT/IB2006/004202, dated Oct. 19, 2007.

International Search Report for PCT/US04/04530, dated Aug. 5, 2004.

Invitation to Pay Additional Fees and Annex to Form PCT/ISA/206 Communication Relating to the Results of the Partial International Search for PCT/IB2006/004209, dated Oct. 16, 2007.

New Zealand Examination Report for New Zealand Patent Application No. 573730, dated Jul. 8, 2010.

New Zealand Examination Report for New Zealand Patent Application No. 571453, dated Mar. 10, 2010.

Partial International Search Report for PCT/IB2008/001383, dated Nov. 11, 2008.

Written Opinion for PCT/US04/04530, dated Aug. 5, 2004.

Written Opinion for PCT/IB2006/004202, dated Oct. 19, 2007.

* cited by examiner

FIG. 18
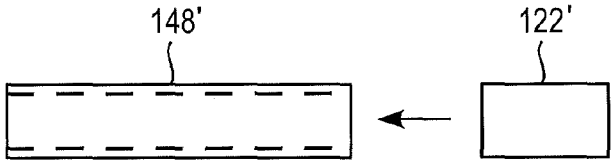
FIG. 18A
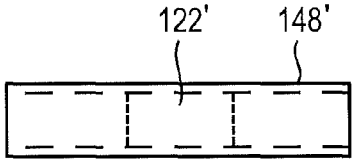
FIG. 18B
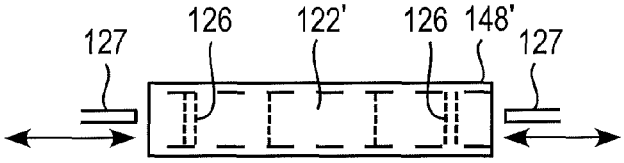
FIG. 18C
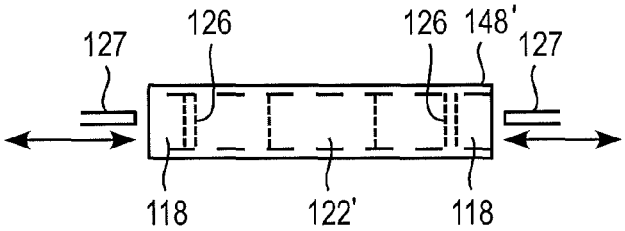
FIG. 18D
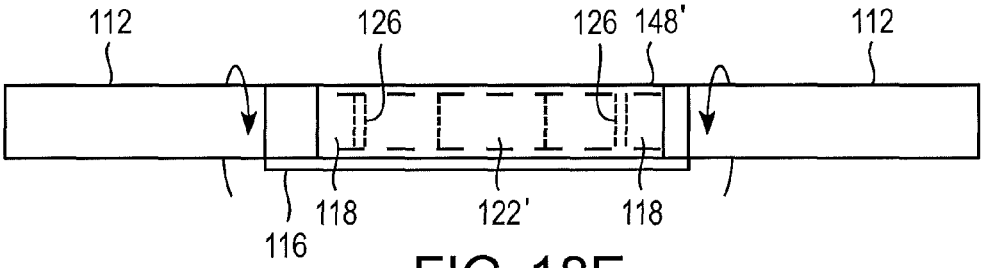
FIG. 18E
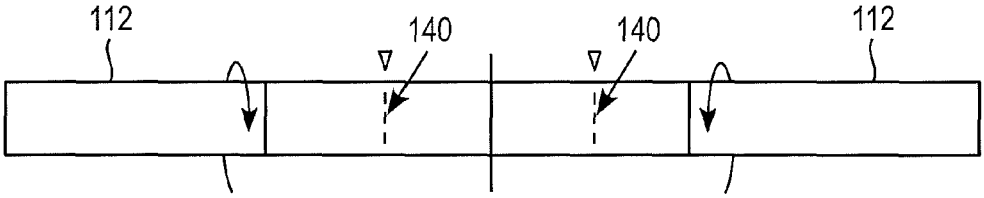
FIG. 18F

SMOKING ARTICLE WITH A RESTRICTOR

CROSS REFERENCE TO RELATED APPLICATION

This application is a divisional of U.S. patent application Ser. No. 11/727,825, entitled SMOKING ARTICLE WITH A RESTRICTOR, filed on Mar. 28, 2007 now U.S. Pat. No. 7,878,963, which claims priority under 35 U.S.C. §119(e) to U.S. Provisional Application No. 60/786,352, filed on Mar. 28, 2006, U.S. provisional Application No. 60/858,407, filed Nov. 13, 2006, and U.S. provisional Application No. 60/905,833, filed Mar. 9, 2007, the entire content of each is incorporated herein by reference.

BACKGROUND

Heretofore, cigarettes with high levels of ventilation have usually had unacceptably low levels of resistance to draw (RTD) unless some counter measure was in place to make-up the shortfall in RTD. In the past, high density cellulose acetate filter segments were used to address the shortfall. However, such filtered segments tended to reduce tar delivery (FTC) with little or no effect upon gas phase components of mainstream tobacco smoke, such as carbon monoxide (CO) and nitrogen oxide (NO). This solution tended to worsen the CO to tar (FTC) ratios in lower delivery (FTC tar) cigarettes.

Ventilation has a desirable attribute in that, when operating alone, it will reduce both the particulate phase and the gas phase constituencies of mainstream smoke. Highly ventilated cigarettes however have drawbacks in RTD as previously discussed.

BRIEF DESCRIPTION OF THE DRAWINGS

FIG. 18 illustrates a process whereby filter rods are formed and inserted into smoking articles.

DETAILED DESCRIPTION OF PREFERRED EMBODIMENTS

Presently disclosed embodiments provide the benefit of a highly ventilated smoking article with desired amounts of resistance to draw and/or provisions for facilitating high speed cigarette manufacturing utilizing high speed filter rod and cigarette making equipment.

Figure 1:
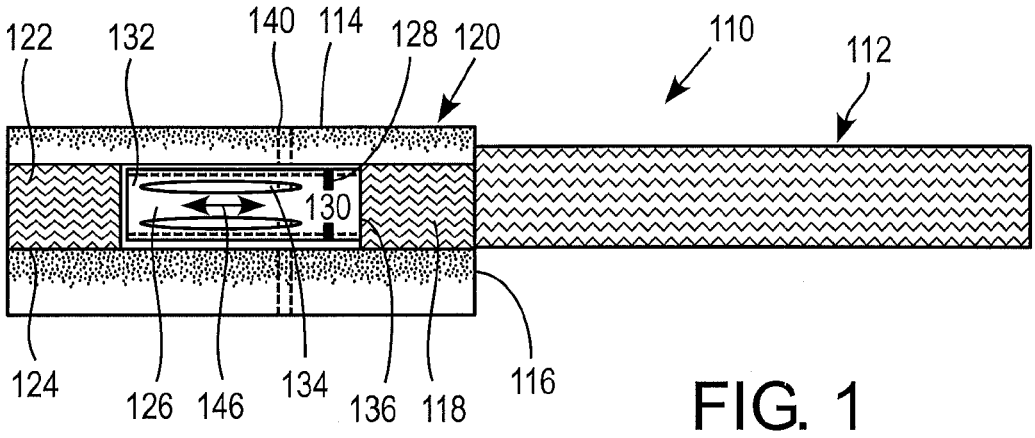
FIG. 1 is a side view of the smoking article constructed in accordance with a preferred embodiment, wherein the filter tipping paper has been partially unfolded to reveal internal filter components.

Referring to FIG. 1, a preferred embodiment provides a smoking article 110 comprising a tobacco rod 112 and a filter 114 connected with the tobacco rod 112 by a tipping paper 116. Preferably, the filter 114 comprises a first filter segment 118 at an upstream end portion 120 of the filter 114, a mouthpiece filter segment 122 at downstream end portion 124 of the filter 114, and a flow restricting ("restrictor") filter segment 126 situated between the first and mouthpiece filter segments 118 and 122. In this embodiment, filter segments 118 and 122 are low particulate efficiency filter segments preferably constructed from cellulose acetate tow of 8.0 denier per filament or greater and 35,000 total denier or less, for example. In a preferred embodiment, regardless of the manner of construction of the low particulate efficiency filter segment, such efficiency is preferably as low as possible, preferably lower than 30%, even more preferably lower than approximately 20% efficiency. In this embodiment, the flow restricting filter segment 126 comprises an annular partition 128 that defines an orifice (or flow restriction) 130 of reduced diameter. Preferably, the flow restricting filter segment 126 also includes a tubular body portion 132 in downstream relation to the annular partition 128. The tubular body portion 132 includes a plurality of elongate holes 134 that are circumferentially disposed about the tubular body segment portion 132. The flow restricting filter segment further comprises a second upstream tubular body portion 136 that spaces the flow restriction 130 a predetermined distance apart from the first filter segment 118, preferably approximately 1 to approximately 6 millimeters (mm), preferably approximately 1 to 3 mm.

A ventilating zone 140 is established with a first row (and optionally second and possibly third rows) of ventilation holes through the tipping paper 116. In the preferred embodiment, the holes 134 provided about the circumference of the flow restricting filter segment 126 are overlapped by (superposed by) at least some of the ventilation holes at the ventilating zone 140 so that air may be drawn through the ventilation holes at zone 140 and through the flow restricting filter segment and into cavity 146 defined between the flow restriction 130 and the mouthpiece filter segment 122.

Preferably the ventilating zone 140 is located near or adjacent to the restriction 130 and spaced from the mouthpiece filter 122 so that air drawn through the ventilation zone 140 is allowed to mix with the mainstream smoke before arriving at the mouthpiece filter 122.

Preferably, the distance between the ventilation zone 140 and the mouthpiece filter 122 is at least 5 mm or in the range of 5-12 mm.

Preferably, the ventilation zone 140 and the holes 134 in the flow restricting filter segment 126 achieve a ventilation level of the smoking article of at least 25% and more preferably at least 50% to 90%.

Figure 2:
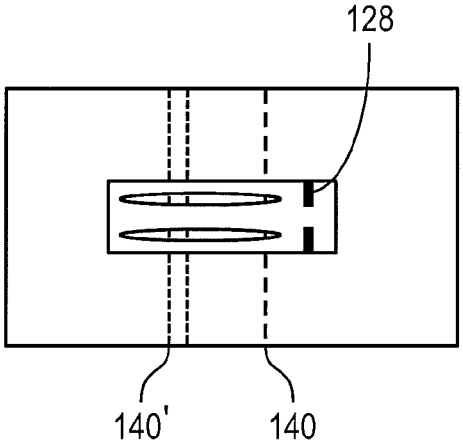
FIG. 2 is a detail side view of a flow restricting filter segment adjacent a completely unfolded piece of tipping paper.

Referring now also to FIG. 2, it may be desirable to provide several ventilating zones 140, 140' at locations in superposing relation to the holes 134 provided in the flow restricting filter segment 126 so as to achieve the more elevated ventilation levels.

Figure 3:
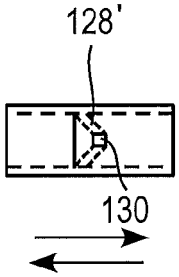
FIG. 3 is a side, cross-sectional view of an alternate design of a flow restricting filter segment.
Figure 4:
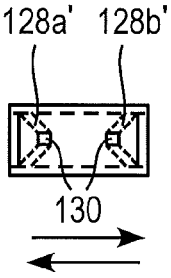
FIG. 4 is a side, cross-sectional view of another alternate design for a flow restricting filter segment.

Referring now to FIGS. 3 and 4, the partition 128 that establishes the flow restriction 130 may be frustoconical and convergent either into or away from the direction of flow of mainstream smoke passing therethrough (as indicated by the arrows in FIGS. 3 and 4). Furthermore, they may comprise a pair of partitions 128*a'* and 128*b'* that are arranged internally within the flow restricting filter segment so as to provide end to end symmetry for the flow restricting filter segment. A filter component having end to end symmetry facilitates high speed filter rod making in that the component works the same whether or not the rod making machine orients one end of the component first or reverses it.

Figure 5:
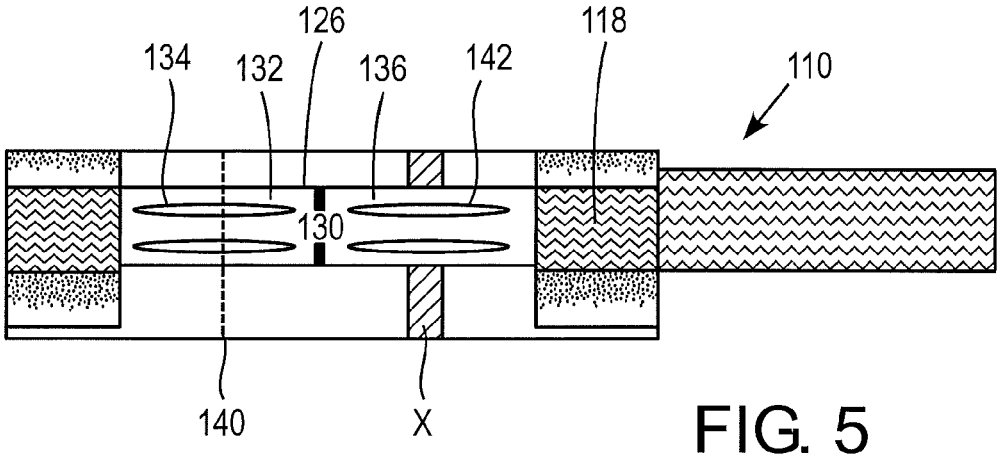
FIG. 5 is a side view of a smoking article with the tipping paper partially unwrapped to reveal filter components including a flow restricting filter segment having end-to-end symmetry.

Referring now to FIG. 5, an alternate embodiment of the present invention includes a flow restricting filter segment having end to end symmetry by reason of the first tubular body portion 132 of the flow restricting filter segment 126 being of equal length with the second, upstream tubular body portion 136 of the flow restricting filter segment 132. In this embodiment, the second upstream tubular body portion 136 includes a plurality of holes 142 about its circumference in same fashion as holes 134 are disposed about the circumference of first downstream tubular body portion 132. By such arrangement manufacture of the filter is facilitated by the end to end symmetry of the flow restricting filter segment 126.

Furthermore, the embodiment of FIG. 5 also provides opportunity to define a second zone X of ventilation upstream of the restriction 130 in addition to or in lieu of ventilation zone 140 as provided in the preferred embodiment.

Figure 6:
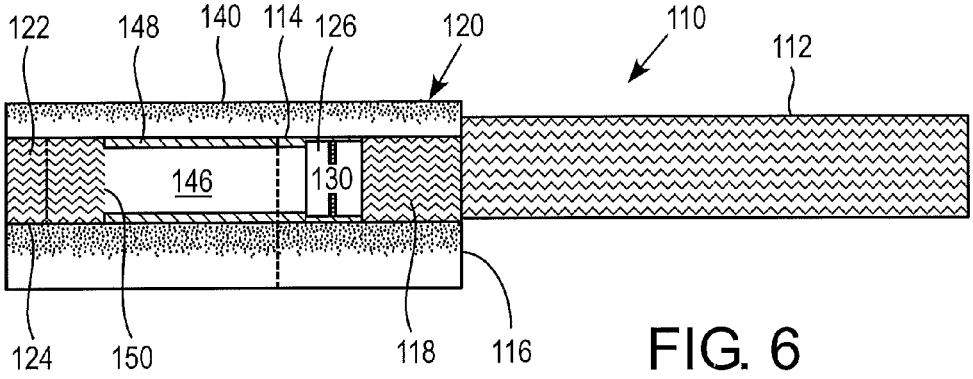
FIG. 6 is an illustration of a smoking article including a filter having a flow restriction device of a preferred embodiment, wherein the filter tipping paper has been partially unfolded to reveal internal filter components.

Referring now to FIG. 6, a preferred embodiment provides a smoking article 110 comprising a tobacco rod 112 and a filter 114 connected with the tobacco rod 112 by a tipping paper 116. Preferably, the filter 114 comprises a first filter segment 118 at an upstream end portion 120 of the filter 114, a mouthpiece filter segment 122 at downstream end portion 124 of the filter 114, and a flow restricting filter segment 126 situated between the first and mouthpiece filter segments 118 and 122 and preferably adjacent the first, upstream filter segment 118. The flow restricting segment 126 preferably includes one or more flow restriction passages 130 there through. In this embodiment, filter segments 118 and 122 are low particulate efficiency filter segments preferably constructed from less densely packed, large diameter fiber cellulose acetate tow of approximately 5.0 denier to approximately 15.0 denier per filament (dpf), such as 8 dpf, and approximately 10,000 to approximately 50,000 total denier (td), such as 35,000 td. Also in this embodiment, a relatively short flow restricting filter segment 126 (hereinafter, restrictor disc) is adjacent the first upstream filter plug 118 of a length of approximately 3 to 10 mm, more preferably approximately 3 mm to 7 mm in length. In this embodiment, a central cavity 146 within the filter 114 is defined at least in part by a tubular filter segment 148, such as a cylindrical cellulosic tube and by the spaced apart relation of the mouthpiece filter 122 and the restrictor disc 126. A ventilation zone 140 is provided at a location along the cavity 146, which location is preferably downstream of the restrictor segment 126 and spaced apart from the mouthpiece segment 122. The tubular filter segment 148 is preferably constructed from a relatively heavy filter plug paper or other material such as a hollow cellulose acetate tube.

In this embodiment, the ventilation zone 140 comprises a plurality of ventilation holes which extend through the tipping paper 116 and optionally through the tubular filter segment 148. If the tubular filter segment 148 is constructed of paper, it is preferred that the ventilation holes extend through the tubular segment 148. In either case, this arrangement facilitates the use of online laser perforation techniques to provide ventilation holes during the manufacture of the smoking article 110. Other techniques may be used to create the ventilation zone 140 such as using off-line, pre-perforated tipping paper, mechanical perforation, electrostatic perforation and other techniques.

Figure 7:
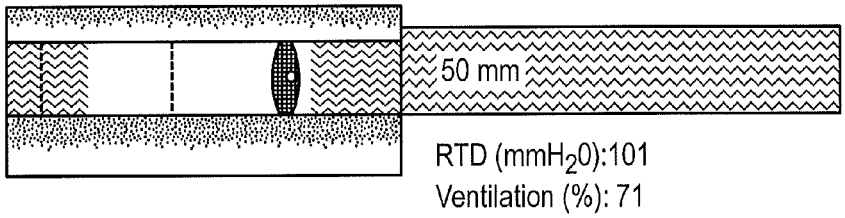
FIGS. 7-9 are representations of experimentally measured values of RTD and ventilation of an unlit smoking article constructed with downstream ventilation.
Figure 8:
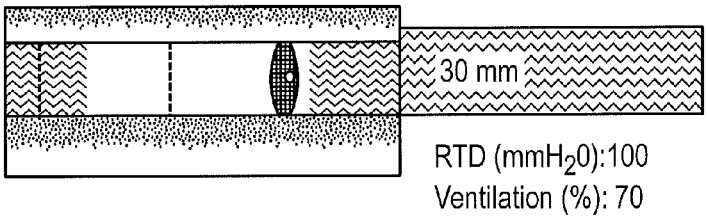
Figure 9:
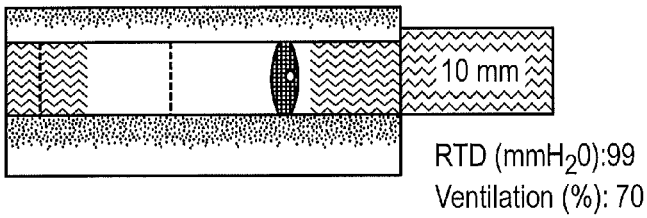

Referring now to FIGS. 7-9 and Table 1 below, for unlit cigarettes having downstream ventilation and an upstream restriction, a desired degree of ventilation (approximately 70%) is maintained throughout the puff count.

Figure 10:
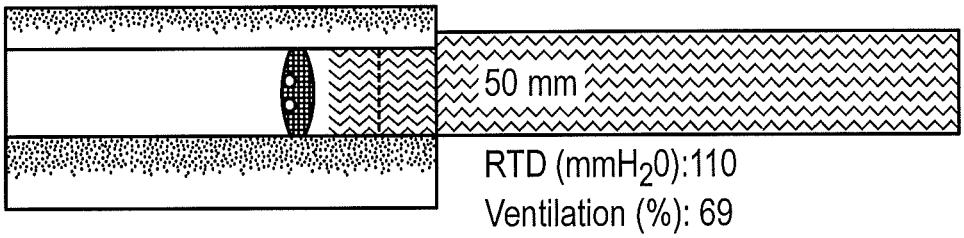
FIGS. 10-12 are representations of experimentally measured values of RTD and ventilation of an unlit smoking article constructed with upstream ventilation.
Figure 11:
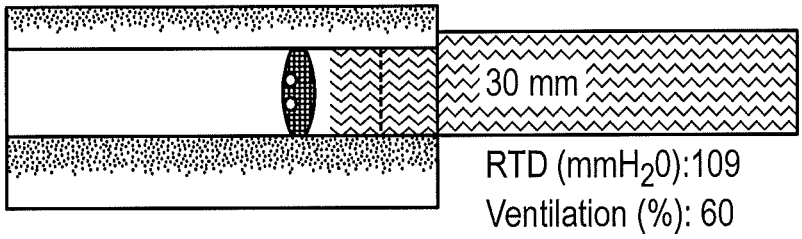
Figure 12:
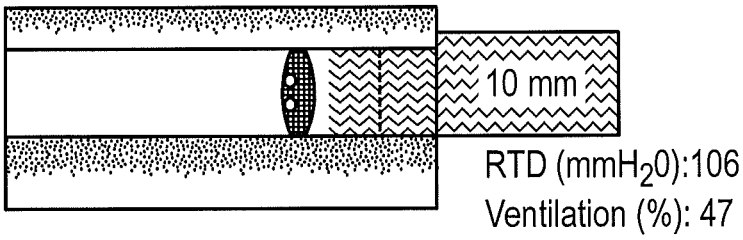

Referring now to FIGS. 10-12, in contrast, when ventilation holes are placed upstream of the restriction, ventilation tends to drop as one progresses through the puff count.

TABLE 1

| Remainder of Tobacco Rod | Restrictor Upstream of Ventilation | Restrictor Downstream of Ventilation |
|---|---|---|
| 50 mm | RTD (mm $H_2O$): 101<br>Ventilation (%): 71 | RTD (mm $H_2O$): 110<br>Ventilation (%): 69 |
| 30 mm | RTD (mm $H_2O$): 100<br>Ventilation (%): 70 | RTD (mm $H_2O$): 109<br>Ventilation (%): 60 |
| 10 mm | RTD (mm $H_2O$): 99<br>Ventilation (%): 70 | RTD (mm $H_2O$): 106<br>Ventilation (%): 47 |

A cigarette having an upstream restrictor 130 with downstream ventilation 140, as described herein, can provide various effects during smoking. For example, as flow rate of a puff increases, pressure drop at the restrictor increases more rapidly compared to a conventional CA filter. Thus, the restrictor works in this configuration as a limiter on the extent to which a smoker may attempt to draw harder on a smoking article during a puff. In addition, having the ventilation zone 140 downstream of the restrictor orifice 130 decouples their respective functionalities (ventilation levels and RTD, respectively) such that a cigarette designer may adjust RTD by changing the size of the restrictor orifice 130 essentially without impacting ventilation levels already established at the ventilation zone 140 and vice versa.

Figure 13:
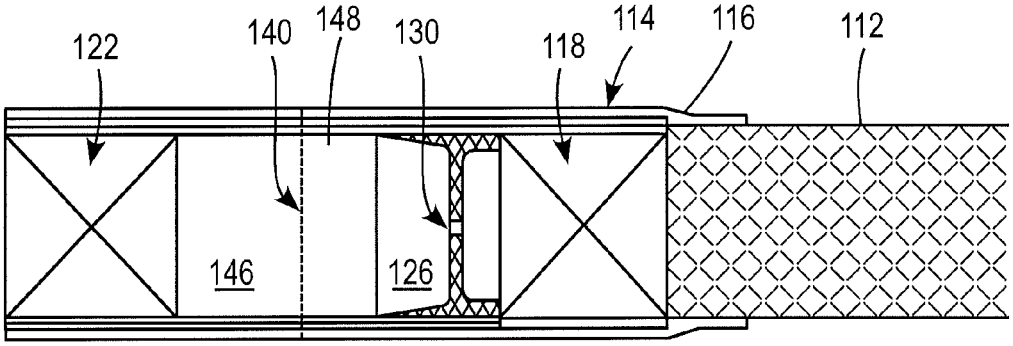
FIGS. 13 and 14 are side views of smoking articles with the tipping paper partially unwrapped to reveal filter components of further embodiments.

Referring to FIG. 13, another embodiment provides a smoking article 110 comprising a tobacco rod 112 and a filter 114 connected with the tobacco rod by a tipping paper 116. Preferably, the filter comprises a first filter segment 118 constructed from cellulose acetate tow at an upstream end portion of the filter, a mouthpiece filter segment 122 constructed from cellulose acetate tow at a downstream end portion of the filter, and a restrictor disc 126 situated between the first and mouthpiece filter segments 118 and 122, and preferably downstream of and adjacent to the first filter segment 118. In this embodiment, the cavity 146 within the filter is defined at least in part by a preferably spiral wound paper tube 148 that preferably extends the whole length of the filter and is sufficiently strong to be self-sustaining, yet thin enough to accommodate on-line laser perforation. The cavity 146 is further defined by the spaced apart relation of the mouthpiece filter 122 and the restrictor disc 126. The outer annulus of the restrictor disc preferably has a sliding fit with the inner surface of paper tube 148. A ventilation zone 140 is provided at a location along the cavity 146, which location is preferably downstream of the restrictor segment 126 and spaced apart from the mouthpiece segment 122. The tube 148 can be made using other materials or other forming techniques such as molding or extruding the tube or forming a tube with a longitudinal seam. Preferably, the filter segments 118 and 122 have low particulate efficiency and are constructed as previously described.

Figure 14:
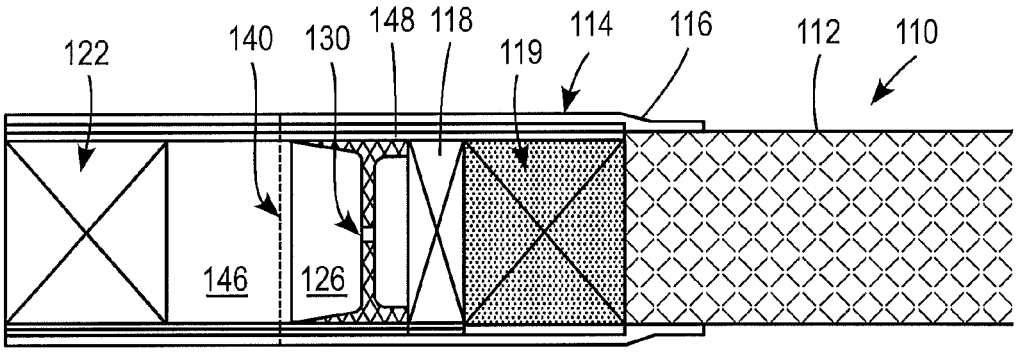

Referring to FIG. 14, another embodiment provides a smoking article 110 comprising a tobacco rod 112 and a filter 114 connected with the tobacco rod by a tipping paper 116. Preferably, the filter 114 comprises a first filter segment 119 constructed from carbon on tow at an upstream portion of the filter 114, a second filter segment 118 constructed from cellulose acetate tow downstream of the first filter segment 119, a mouthpiece filter segment 122 constructed from cellulose acetate tow at a downstream end portion of the filter, and a restrictor disc 126 situated between the second and mouthpiece filter segments 118 and 122. In this embodiment, the outer annulus of restrictor disc 126 is preferably slightly frustoconical to facilitate plunging of restrictor disc 126 along tube 148 from left to right, as shown in FIG. 14. Preferably, as in the previous embodiment, a cavity 146 extends from the mouthpiece filter 122 to the flow restriction 130 and a ventilation zone 140 communicates with the cavity 146 at a location spaced from the mouth-piece plug 122.

Figure 15:
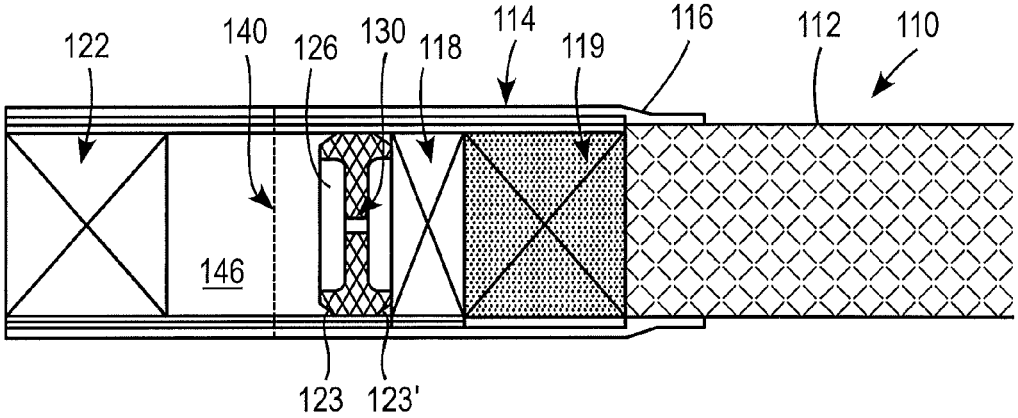
FIG. 15 is a side view a smoking article with the tipping paper partially unwrapped to reveal filter components including a flow restricting filter segment having end-to-end symmetry.

Referring to FIG. 15, another embodiment provides a smoking article 110 comprising a tobacco rod 112 and a filter 114 connected with the tobacco rod by a tipping paper 116. In this embodiment, the layout of the filter 114 is like that of the embodiments described above in reference to FIG. 14, except that the restrictor disc 126 preferably is symmetrical or has end-to end symmetry so that the restrictor disc can be reversed without affecting its performance. Preferably, the disc 126 has beveled edges 123, 123' to facilitate sliding. This version of the restrictor disc 126 may be used in the filter layout described with reference to FIGS. 13, 16, and 17 as well.

Figure 16:
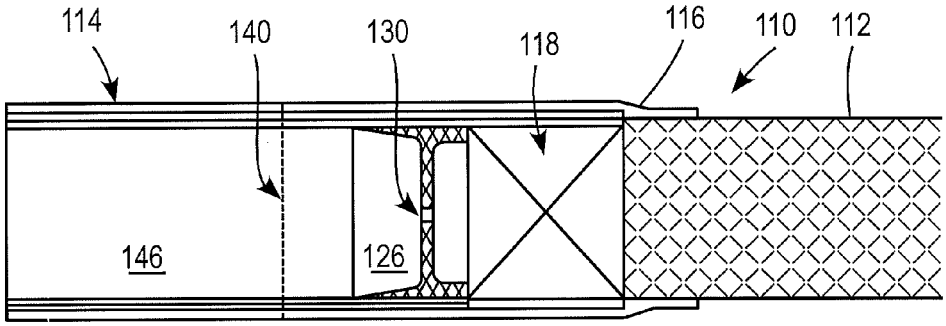
FIGS. 16 and 17 are side views of smoking articles with the tipping paper partially unwrapped to reveal filter components of further embodiments.
Figure 17:
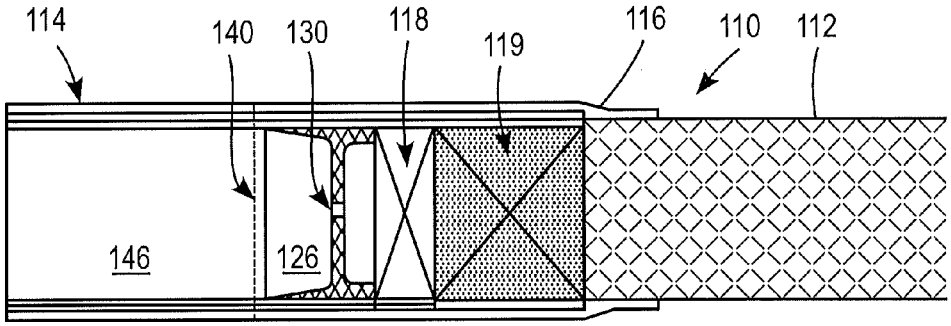

Referring to FIGS. 16 and 17, embodiments provide a smoking article 110 comprising a tobacco rod 112 and a filter 114 connected with the tobacco rod by a tipping paper 116. In these embodiments, the filters 114 are like those of the embodiments described with reference to FIGS. 13 and 14, respectively, but without the mouthpiece filter segment 122, so that impaction and other filtration effects are further minimized.

FIG. 18 illustrates an embodiment of a process whereby 2-up filter rods including a flow restrictor device are constructed and then fed into a tipping machine to form smoking articles. FIG. 18A illustrates a double length (2-up) paper filter tube 148' and a double length (2-up) cellulose acetate mouthpiece segment 122'. The double length cellulose acetate segment 122' is plunged or otherwise placed centrally in the double length paper filter tube 148', as illustrated in FIG. 18B. Restrictor discs 126, 126 are plunged or otherwise placed into position in spaced-apart relation to opposite ends of the 2-up segment 122' by sliding into opposite ends of the tube 148', for example, using plungers 127, as illustrated in FIG. 18C. One-up first filter segments 118, 118 are then plunged or otherwise placed into place by sliding into opposite ends of the tube 148' adjacent the restrictor discs 126, 126, for example, using plungers 127, as illustrated in FIG. 18D. The resulting double length filter rod is inserted between two spaced apart tobacco rods 112, 112 and secured with tipping paper 116, as illustrated in FIG. 18E. Optional laser perforation 140 takes place and then the 2-up cigarettes are severed, as illustrated in FIG. 18F. All of these operations can be carried out using high speed filter rod and cigarette making machinery.

In manufacturing embodiments having a filter segment 119, a two-up mouthpiece filter segment 122 is first disposed at the central location of the two-up tube 148' and the restrictor plugs 126 are set in place. Thereafter, one-up segments 118 and then the one-up carbon on tow segment 119 are plunged or otherwise placed on opposite sides adjacent the restrictor plugs.

Referring to FIG. 14, preferred dimensions for an 83 mm smoking article include, for example, a filter length of 27 mm, comprising a paper tubing 27 mm in length, a mouth end filter segment length of 7 mm, ventilation holes 12 mm from the mouth end of the smoking article, a restrictor disc length of 5 mm length separated from the mouth end segment by a 5 mm long cavity, a cellulose acetate (CA) tow segment length of 2.5 mm upstream of the restrictor disc, and a carbon on tow (COT) filter segment length of 7 mm upstream of the CA segment.

The ventilation zone 140 is established with a first row (and optionally second and possibly third rows) of ventilation holes through the tipping paper 116 and filter tube 148'. Accordingly, air is preferably drawn through the ventilation holes of ventilation zone 140 and into the cavity 146 defined between the flow restriction 130 and the mouthpiece filter segment 122.

Preferably the ventilation zone 140 is located near or adjacent to the flow restriction 130 and spaced from the mouthpiece filter 122 so that air drawn through the ventilation zone 140 is allowed to mix with the mainstream smoke before arriving at the mouthpiece filter 122. Preferably, the distance between the ventilation zone 140 and the mouthpiece filter 122 is at least 5 mm or in the range of 5-20 mm. By such arrangement, impaction of mainstream smoke at the mouthpiece filter 122 is minimized.

Preferably, the ventilation zone 140 achieves a ventilation level of the smoking article of at least 25% and more preferably at least 50% to 90%, e.g., 60%, 70%, or 80%.

The restrictor disc 126 may comprise an impermeable partition (transverse wall) having one or more orifices therein, that establishes the flow restriction 130, with the restriction specifically in the form of an orifice of reduced diameter. If desired, the partition can be perpendicular to the longitudinal axis of the smoking article or frustoconical and convergent either into or away from the direction of flow of mainstream smoke passing therethrough. Furthermore, the restrictor disc 126 may be configured to provide end to end symmetry. A filter component having end to end symmetry facilitates high speed filter rod making in that the component works the same whether or not the rod making machine orients one end of the component first or reverses it.

A restrictor disc 126 having end to end symmetry has tubular body portions of equal length on opposite sides of a transverse wall (partition). By such arrangement manufacture of the filter is facilitated by the end to end symmetry of the restrictor disc 126.

Optionally, a zone of ventilation may be located upstream of the flow restriction 130 in addition to ventilation zone 140 as provided above.

Manufacture of the smoking articles 110 in accordance with the present disclosure may be facilitated with the use of pre-perforated tipping paper.

Preferably the flow restriction 130 is sized to contribute sufficient pressure drop such that the smoking article 110 presents a resistance to draw of at least 40 mm water or greater, preferably in the range of 50-100 mm water. Preferably, the partition (transverse wall) has a diameter of approximately 7.0 to 8.0 mm and more preferably approximately 7.4 to 7.8 mm wherein the partition preferably has one or optionally, more than one orifice of a diameter of about 0.5 mm to about 1.0 mm and more preferably about 0.5 to 0.7 mm. Since the pressure drop of the restrictor component depends on the open area, multiple orifices can also be used. For example, in one embodiment there are two orifices in the partition of 0.5 mm diameter each.

The restrictor disc 126 may be constructed of paper, a plastic, polymer or a metal and more preferably made of a paper product or a biodegradable plastic/polymer or other suitable material having biodegradability properties. However, in the case of plastic being used, the restrictor disc 26, in the embodiments shown in FIGS. 6 and 13-17, is small and the non-biodegradable content of the filter is minimized.

Preferably, the flow restriction 130 and the mouthpiece filter 122 are spaced apart sufficiently to reduce impaction of particulate smoke components upon the upstream face of the mouthpiece filter 122. Preferably, the flow restriction 130 is spaced approximately 4 mm to 20 mm from the mouthpiece filter 122, more preferably approximately 6 to 10 mm.

It is to be appreciated that the filter preferably may be constructed from simple combining techniques typically used in the industry for manufacturing cigarettes at high speeds. Additionally each embodiment includes tubular support about the cavity 146 so as to provide desired firmness throughout length of the filter 114. Furthermore, the embodiments provide the necessary amount of resistance to draw while maintaining the desired degree of high ventilation throughout the puff count. The latter attribute is achieved by placement of the ventilation zone 140 downstream of the flow restriction 130. Furthermore, placing the ventilation along cavity 146 assures mixing of air drawn into the filter 114 through the ventilation zone 140 with mainstream smoke drawn from the tobacco rod 112. In one tested embodiment, uniform stain patterns appeared at the buccal end of the mouthpiece filter 122, which is indicative of good mixing.

During smoking of a cigarette constructed in accordance with the present disclosure, a consistent degree of ventilation (e.g., 50 to 90%, preferably about 70%) is preferably maintained throughout the puff count as shown in FIGS. 7-9 and Table 1.

In contrast, when ventilation holes are placed upstream of the flow restriction 130, ventilation tends to drop as smoking progresses through the puff count as shown in FIGS. 10-12 and Table 1.

Figure 19:
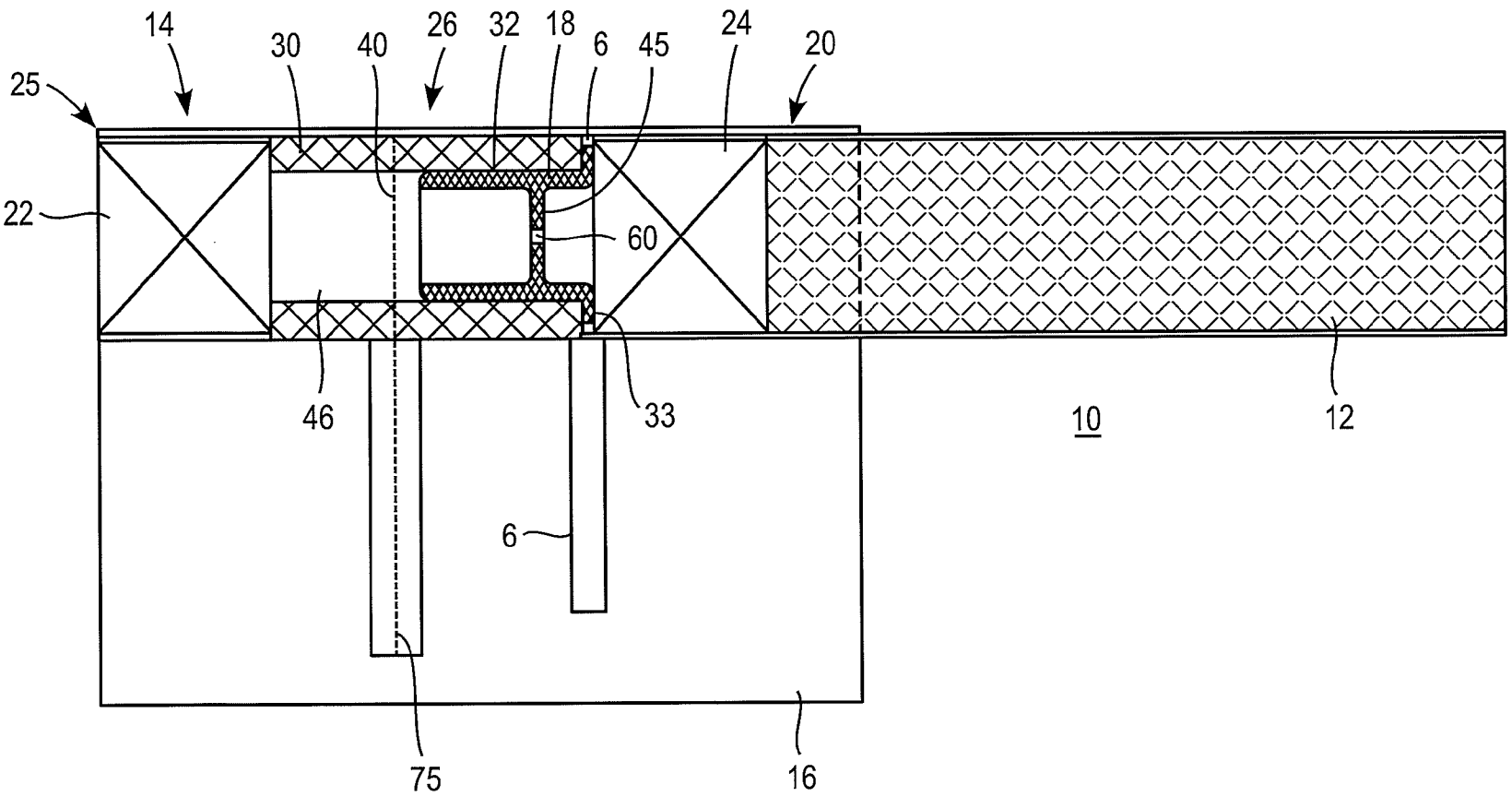
FIG. 19 is a side view of a smoking article including a preferred embodiment flow restrictor filter, wherein the filter tipping paper has been partially unfolded to reveal internal filter components that are shown in cross-section.

Referring now to FIG. 19, a smoking article 10 comprising a tobacco rod 12 and a filter 14 connected with the tobacco rod 12 by tipping paper 16 is shown. Preferably, the filter 14 comprises an optional filter segment 24 of low particulate efficiency at an upstream end portion 20 and an optional mouthpiece filter segment 22 of low particulate efficiency at the downstream end 25 of the filter 14. Preferably, a flow restricting filter segment 26 (or component) is situated upstream of a ventilation zone 40 that communicates with a cavity 46.

In a preferred embodiment, a smoking article 10 includes a flow restricting filter segment 26 received in an air transmissive tubular segment 30. During manufacturing operations, a T-restrictor insert 18 is plunged into the upstream end portion of the tubular segment 30.

In this embodiment, the tubular segment 30 is constructed from cellulose acetate tow (sometimes referred to as a hollow acetate tube or HAT) and the T-restrictor insert 18 includes a transverse disc shaped wall 45 with one or more openings 60 therein and a longitudinal tubular section 32 extending therefrom having a length of about 3 mm to about 10 mm, more preferably about 3 mm to about 7 mm in length. The T-insert includes an outer rim 33, which is wider than the tubular section 32 such that the insert 18 looks T-shaped in a side view.

In an embodiment, a central cavity 46 within the filter 14 is defined at least in part by the tubular segment 30 and optionally, in part by the space enclosed by the tubular section 32 of the restrictor insert 18. Preferably, a ventilation zone 40 communicates with the cavity 46 at a location downstream of the restrictor insert 18. The tubular segment 30 is preferably constructed from a hollow acetate tube (HAT) and is preferably air permeable (low density) so that ventilation air may be drawn through ventilation holes 75 into the cavity 46 during a puff. Other low density, low filtration materials can also be used to construct the tubular segment 30.

Figure 20:
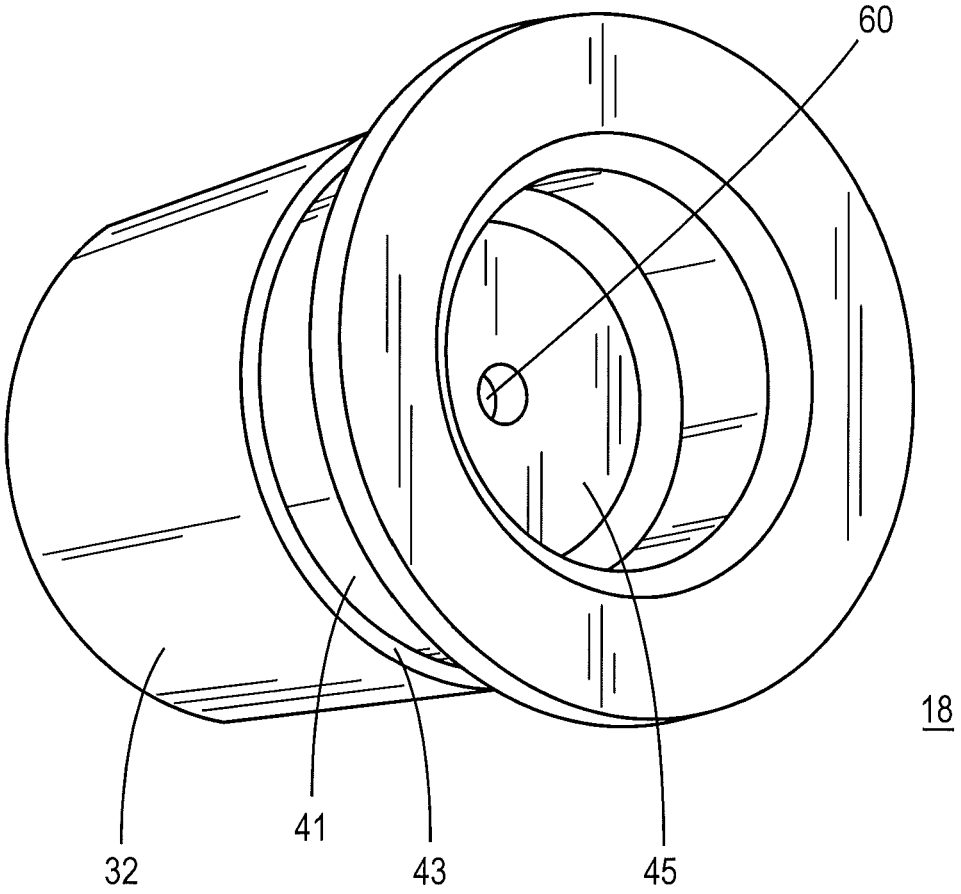
FIG. 20 is a perspective view of a T-restrictor insert of the filter shown in FIG. 19.

During a puff, mainstream smoke is drawn through an orifice 60, illustrated in FIG. 20, in the transverse smoke impermeable wall (disc) 45 of the T-restrictor 18, through the cavity 46, where it is mixed with ventilation air that is drawn into the cavity 46 via the ventilation zone 40. In an embodiment, the orifice 60 is preferably a constant diameter. In another embodiment, the diameter of the orifice 60 varies along the length of the orifice.

In a preferred embodiment, the ventilation zone 40 comprises a plurality of ventilation holes 75 arranged in one or more circumferential rows, which extend through the tipping paper 16 and optionally/partially into or through the tubular segment 30. This arrangement facilitates the use of off-line laser perforation techniques to provide ventilation holes 75. Other techniques may be used to create the ventilation zone 40 such as using on-line, laser perforation, mechanical pin perforation techniques, electrostatic perforation and other techniques.

The ventilation holes 75 in the tipping paper 16 allow atmospheric air to be drawn into the ventilation zone 40, through the tubular segment 30, and into the cavity 46. When a hollow acetate tube forms at least part of the tubular segment 30, perforations need not be made in the tubular filter segment 30 because the material is air permeable.

In a preferred embodiment, the ventilation zone 40 and the tubular filter segment 30 achieve a ventilation level of the smoking article of at least about 25% and more preferably at least about 50% to about 90%.

FIG. 20 is an illustration of the T-restrictor insert 18 shown in FIG. 19. The T-restrictor insert 18 includes a smoke impermeable transverse wall 45 with at least one orifice 60 formed therein. The transverse wall 45 is at an intermediate location along the tubular portion 32 of the T-restrictor insert 18. The outer wall of the tubular portion 32 includes a step 43 which forms a depression 41 to receive material of the HAT 26 and lock the restrictor insert 18 in place.

Figure 21:
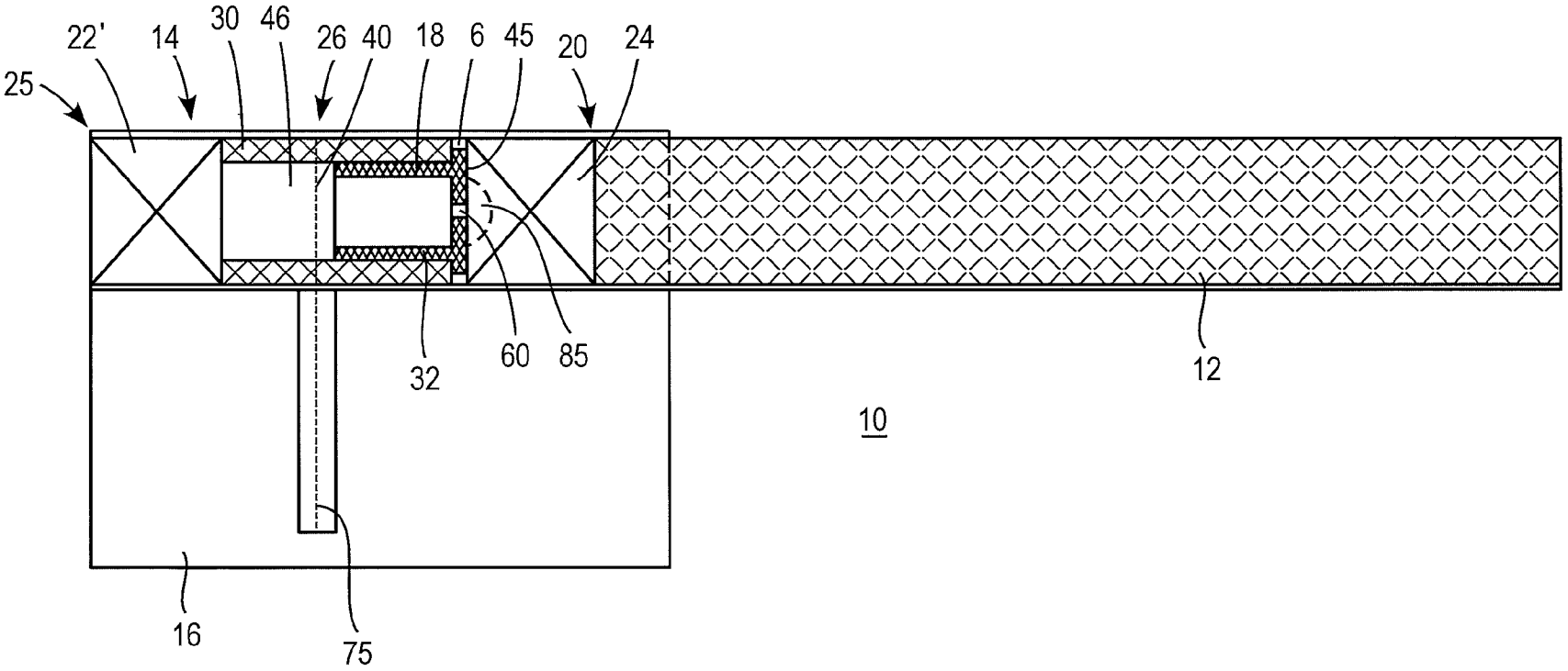
FIG. 21 is a side view of a smoking article including a preferred embodiment flow restrictor filter, wherein the filter tipping paper has been partially unfolded to reveal internal filter components that are shown in cross-section.

FIG. 21 is an illustration of a smoking article 10 including a filter 14 having a T-restrictor insert 18 plunged into one end of the air transmissive tubular portion 30. Optionally, in this embodiment and that of FIG. 19, hot melt adhesive 6 is applied transversely on the filter paper or plug wrap to form a circumferential seal along the outer edge of the rim 33 and to join the T-restrictor insert 18 with first filter segment 24 and the HAT segment 30. Such arrangement further prevents mainstream smoke from being drawn around the outer edges of T-restrictor insert 18.

Figure 22:
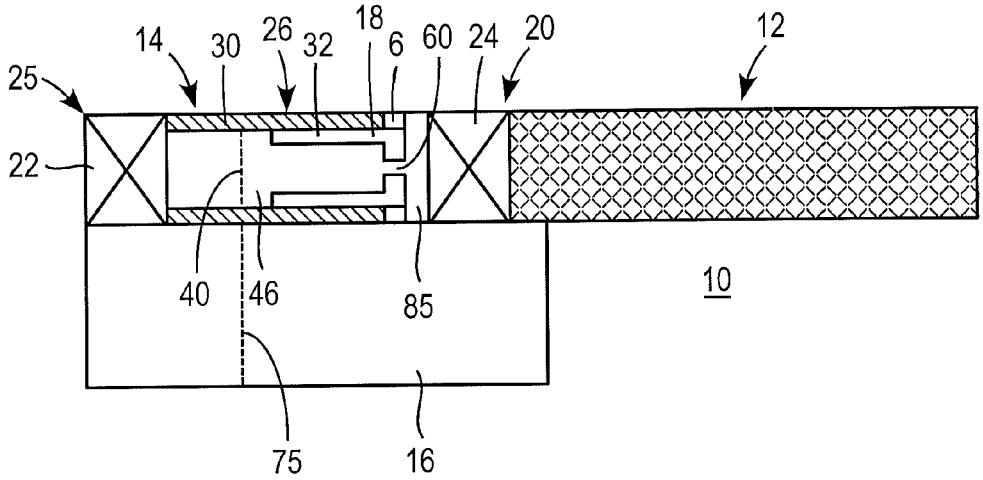
FIG. 22 is a side view of a smoking article including a preferred embodiment flow restrictor filter, wherein the filter tipping paper has been partially unfolded to reveal internal filter components that are shown in cross-section.

FIG. 22 is an illustration of a smoking article 10 including a filter 14 having an upstream filter segment 24 and an upstream cavity 85. The filter includes a tubular segment 30 comprising an air transmissive material and a T-restrictor insert 18 plunged into the upstream end of the tubular segment 30. The T-restrictor insert 18 includes an orifice 60 in the transverse wall 45. The upstream cavity 85 helps prevent blockage of the orifice 60 during smoking.

Figure 23:
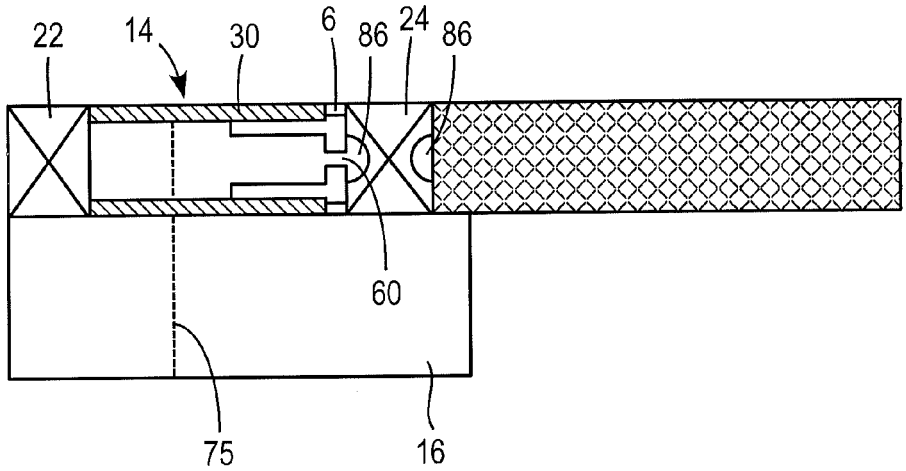
FIG. 23 is a side view of a smoking article including a preferred embodiment flow restrictor filter, wherein the filter tipping paper has been partially unfolded to reveal internal filter components.

Referring now to FIG. 23 in another embodiment, the smoking article 10 includes a filter 14 with an upstream filter segment 24 having central recesses 86 extending into each end. The recesses 86 are axially aligned with the orifice 60 of the T-restrictor insert 18 that is plunged into the tubular portion 30 as in FIGS. 21-22. The recess 86 adjacent the restrictor insert 18 prevents blockage of the orifice 60 from accumulation of tar particles and/or condensates during smoking.

Figure 24:
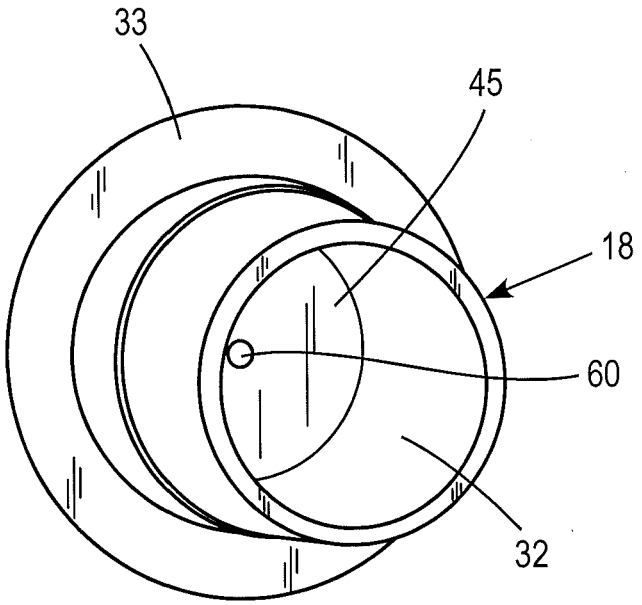
FIG. 24 is a perspective view of a T-restrictor insert of the filter shown in FIGS. 21, 22, and 23.

FIG. 24 is an illustration of the T-restrictor insert 18, shown in FIGS. 21-22, for use in a filter 14. In an embodiment, the T-restrictor insert 18 is a single piece including a hollow tubular portion 32 and a transverse wall (or disc) 45. Preferably, the transverse wall 45 has an orifice 60 located adjacent a central point in the transverse wall 45 of the T-restrictor insert 18, although other positions may be selected and more than one orifice 60 may be provided in the wall 45.

In a preferred embodiment, the elongated portion 32 of the T-restrictor 18 forms a channel with dimensions of about 3 mm to about 9 mm in diameter and about 7 mm to about 10 mm in length. Preferably, the tubular portion 32 fits snuggly inside the tubular segment 30, which is preferably a hollow acetate tube. The transverse wall 45 is preferably sized to cover a substantial portion of the end of the hollow acetate tube once the tubular portion 32 has been inserted therein.

Figure 25:
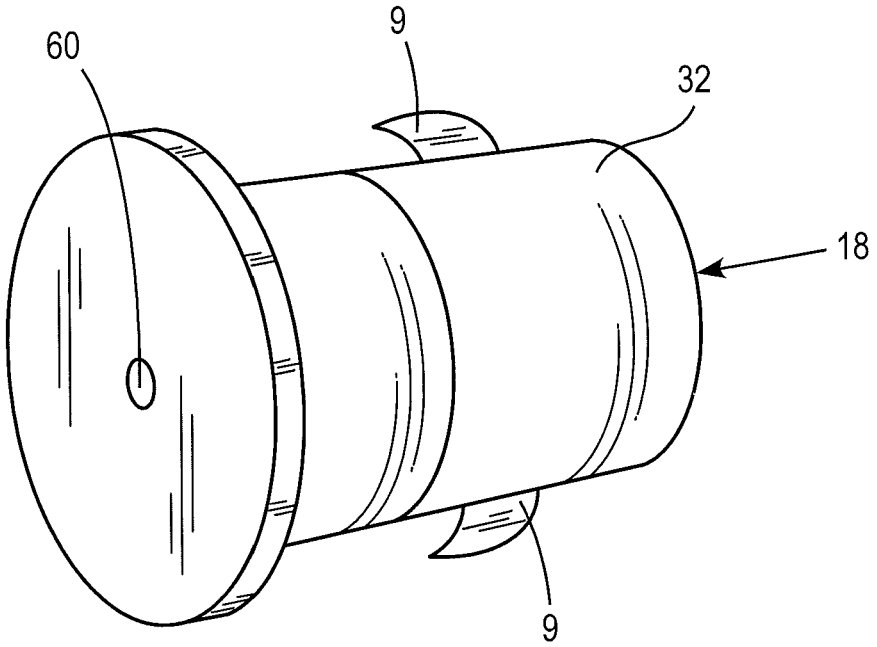
FIG. 25 is a perspective view of a T-restrictor insert of the filter, shown in FIGS. 21, 22, and 23, including barbs.

Referring now to FIG. 25, in an embodiment, the T-restrictor insert 18 can include barbs 9. The barbs 9 anchor the T-restrictor insert 18 inside the hollow acetate tube (HAT) when the elongated portion 32 of the T-restrictor insert 18 is inserted into the HAT.

For ease of manufacturing on high speed filter rod making equipment, the outer diameter of the rim 33 is less than that of the original diameter of the tubular segment 30 prior to filter rod making operations. Preferably, the diameter of the rim 33 is smaller than the pre-determined diameter of the cigarette to be made. For example, for a cigarette having a circumference of 24.1 mm, the circumference of the rim 33 is preferably 1 to 10% smaller, e.g., approximately 23.9 mm or less in the example. As is typically done in established filter rod making techniques, the original diameter or the HAT segment 30 is slightly oversized so that it may be uniformly compressed into the desired diameter (e.g. 24.1 mm), and held in place by the plug wrap during filter making operations. Because the rim 33 is of lesser diameter, the T-restrictor insert 18 passes through the garniture of a filter rod making machine without snagging.

Preferably, the T-restrictor insert 18 is a single piece that is injection molded. The T-restrictor insert 18 is preferably made of a plastic, metal, cellulosic material, and/or composite of a plastic and starch. Suitable plastics include, without limitation, polypropylene, polyethylene, polystyrene, nylon, polysulfone, polyester, polyurethane, and combinations thereof.

Figure 26:
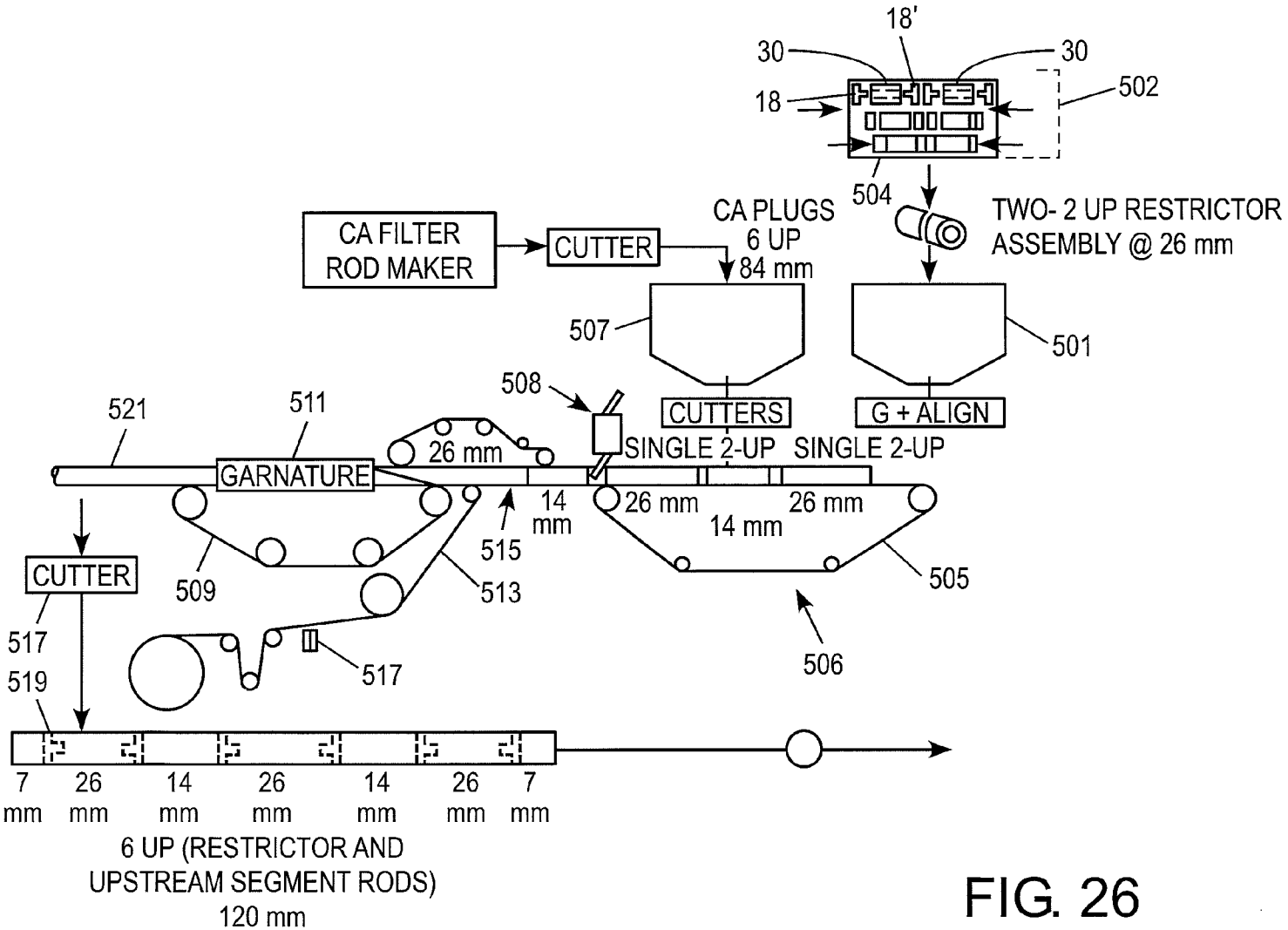
FIG. 26 provides a general representation of DAPTC combiner arranged to perform combining steps of a preferred method of manufacturing the smoking article.

Referring now to FIG. 26, in an example of a high speed manufacturing technique, pairs of HAT segments 30 are each respectively situated along flutes of a drum 504 between opposing pairs of 2-up T restrictor inserts 18, 18' and are all pushed together so that a pair of 2-up HAT restrictor assemblies are established on each flute, which assemblies are each 26 mm long. The pairs are then fed or placed into a first hopper 501 of an upstream section 506 of a double-action plug-tube combiner (DAPTC) combiner. More preferably, this insertion step may be performed on drums just below the hopper 501. From the first hopper 501, the 2-up HAT restrictor assemblies are separated and fed in spaced apart relation onto an endless feed belt 505 of a Molins double-action plug-tube combiner or other combining machine of similar capabilities.

Similarly, continuous cellulose acetate, low particulate efficiency, filter rods are produced and cut into a plurality of CA 6-up/84 mm long rods, which are fed or placed into a second hopper 507 of the DAPTC combiner. During combining operations the 6-up rods are further cut and sorted into 2-up/14 mm segments (corresponding to a 2-up version of the upstream filter segment 24 of FIG. 19) and placed in alternating relation to the restrictor assemblies on the feed belt 505.

At the downstream travel portion of the feed belt 505 a rotating spacer drum 508 establishes a continuous, closed-up procession 515 of the alternating 2-up restrictor assemblies and 2-up CA segments in mutually abutting, end to end relation with one after another. Downstream of the rotating spacer drum 508, the procession is transferred onto a ribbon of plug wrap 513. A garniture belt 509 draws both the procession 515 and the plug wrap 513 through a garniture 511 whereat the plug wrap 513 is wrapped about the procession of plugs 515 so as to form a continuous filter rod 521. Preferably one or more glue guns 517 apply a desired pattern of glue continuously and/or at spaced locations along the ribbon of plug wrap 513 to retain filter rod 521 in its final form. Again, because the rims 33 of the T-restrictor inserts 18 are undersized relative to the target diameter of the filter rod 521, they pass through the garniture 511 and remain set in place at spaced location along the rod 521.

Downstream of the garniture 511 a cutter 517 severs the continuous rod 521 so as to repetitively form a 6-up restrictor/upstream segment assembly (rod) 519. The 6-up rod 519 preferably comprises the following segments from one end to the other: a 1-up/7 mm CA segment at one end of the rod 521; a first 26 mm/2-up restrictor assembly segment; a 14 mm/2-up CA segment; a second 26 mm/2-up restrictor assembly segment; a second 14 mm/2-up CA segment; a third 26 mm/2-up restrictor assembly segment; and a second, 1-up/7 mm at the opposite end of the rod. The 6-up rods 519 are then fed or placed into a first hopper 170 of a dual hopper max tipping machine or a machine of similar capabilities.

Figure 27:
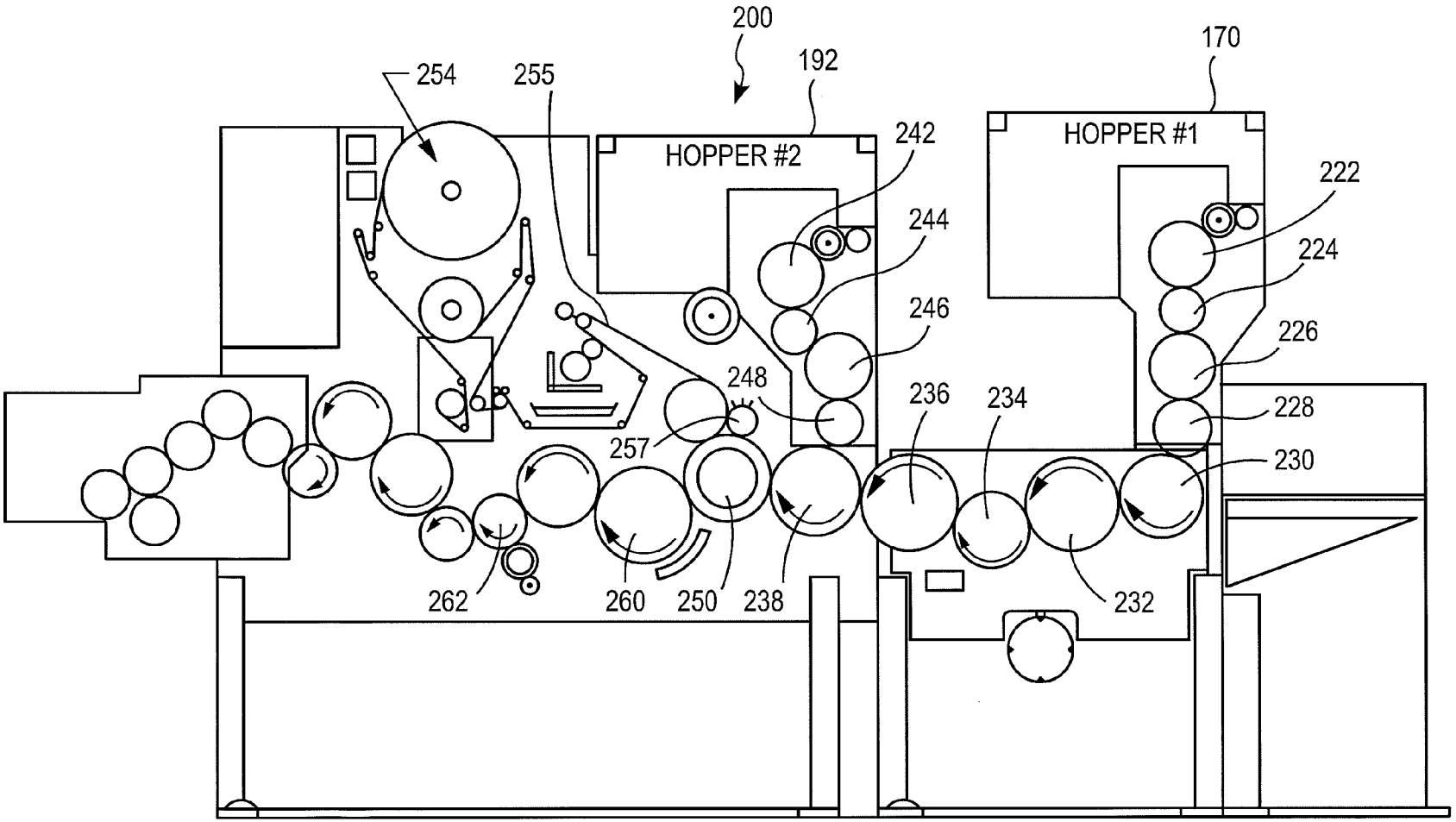
FIG. 27 is a representation of a dual hopper max (DH MAX) which has been adapted to conduct certain further filter combining operations on its drums and to tip pairs of tobacco rods with the resultant combined filters.
Figure 28:
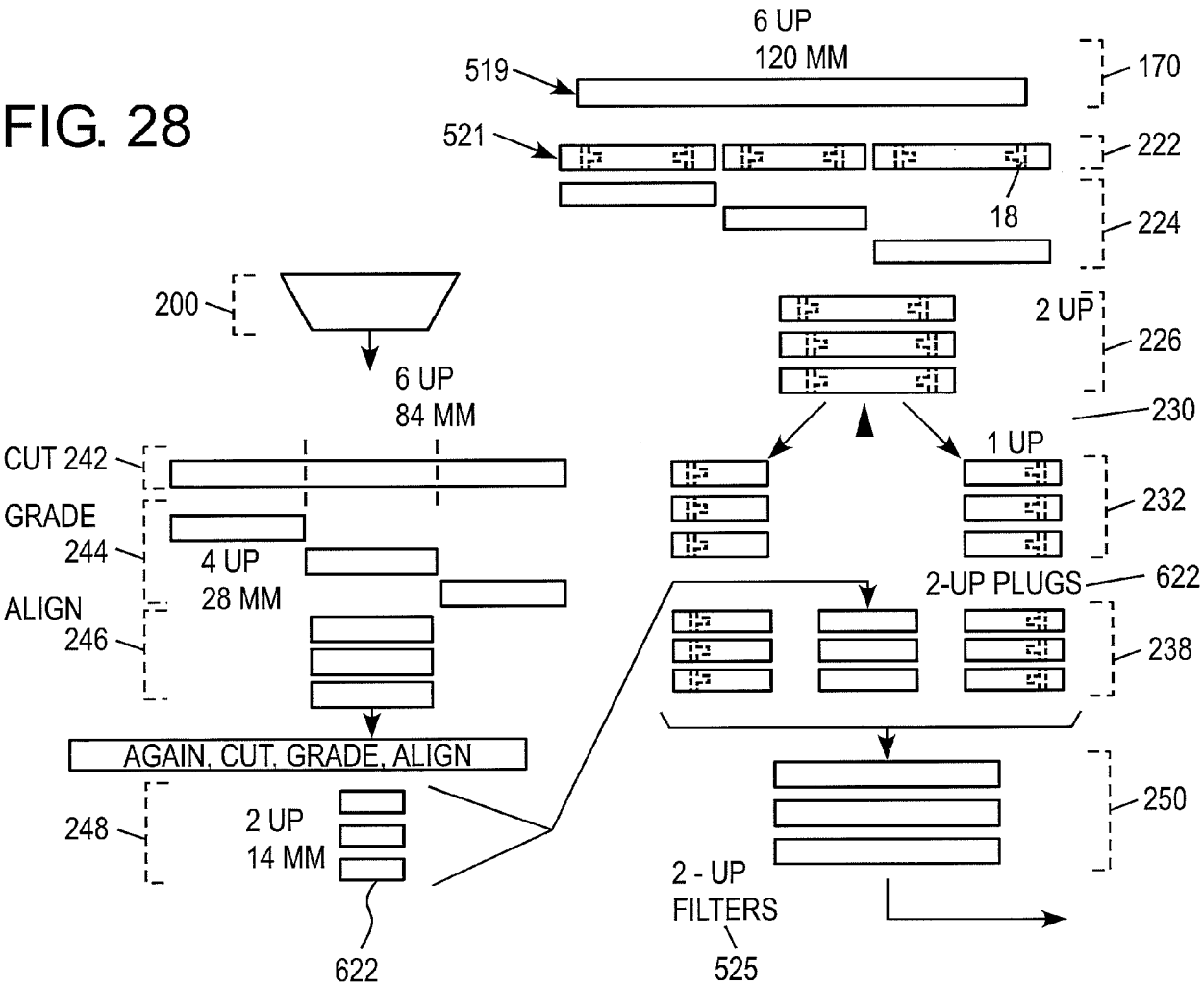
FIGS. 28 and 29 are representations of those further combining steps and tipping operations that are performed on the DH MAX.

Referring now to FIGS. 27 and 28, the 6-up/120 mm rods 519 are then cut into three, 2-up rods 521 at drum 222, then graded at drum 224, aligned at drum 226, whereupon each is cut centrally and spaced apart into opposing pairs of sub-assemblies along each flute of the drum 232. Each sub-assembly comprises a 1-up/7 mm CA segment (corresponding to the upstream segment 24 in FIG. 12), a T-restrictor insert 18 and a 1-up HAT segment, whose open end portion is directed inwardly along the respective drum flute. The pairs of sub-assemblies are then spaced apart sufficiently to receive 2-up/14 mm CA plugs 622 therebetween. The 2-up plugs 622 each correspond to a 2-up version of the downstream (mouthpiece) filter segments 22 shown in FIG. 19.

The 2-up plugs 622 are preferably constructed from similar cutting, grading and aligning operations on 6-up 84 mm long filter rods at drums 242, 244 and 246 of the DHMAX represented in FIG. 27, with further cut, grade and align operations occurring at or about the drum 248.

Figure 29:
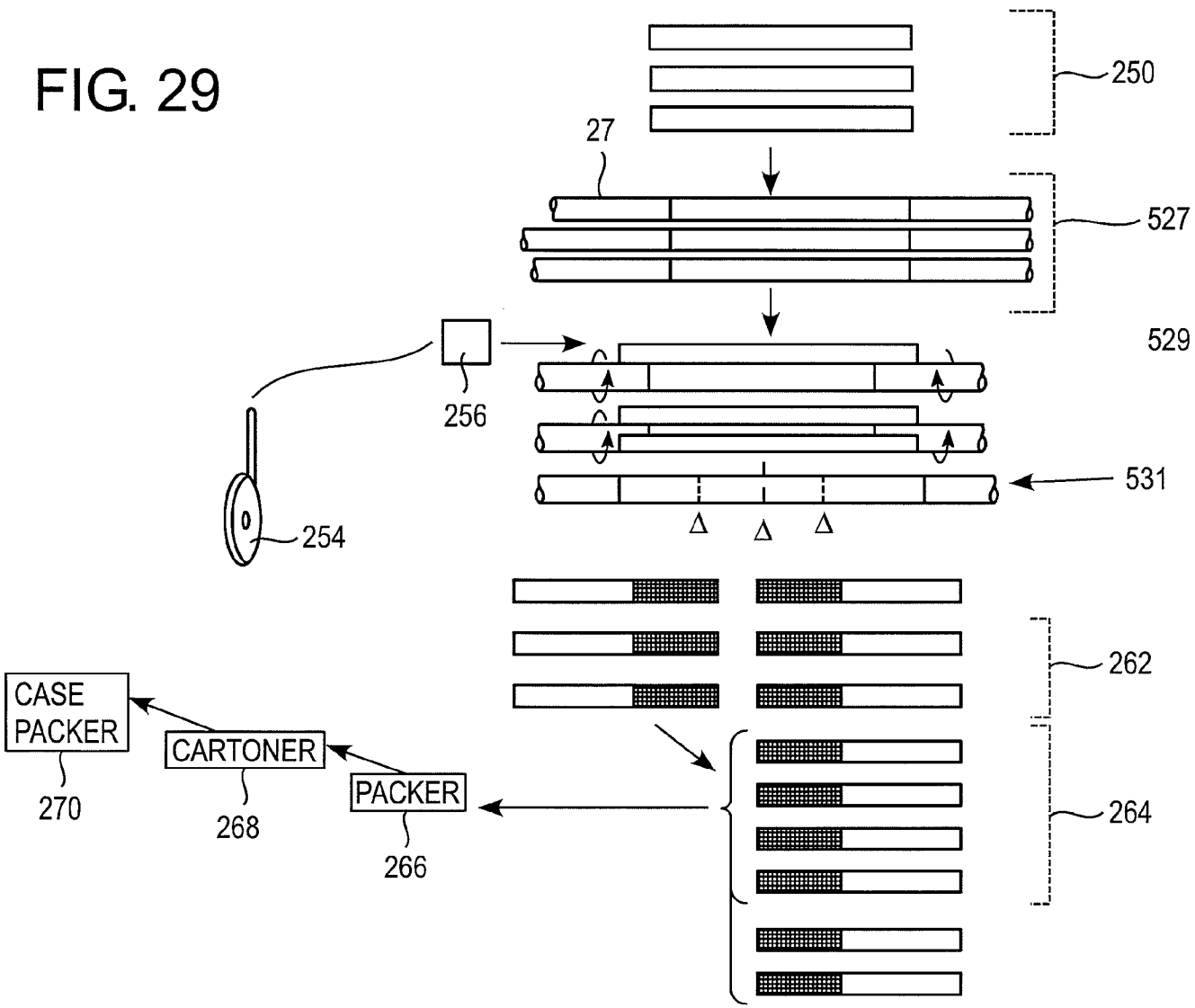

Referring back to operations at 238, the plugs are brought together at drum 250 to form a complete 2-up filter structures 525, which are then fed in between pairs of spaced apart tobacco rods 527, as illustrated in FIG. 29, and wrapped with tipping paper 529 in accordance with the usual tipping operations of a Dual Hopper Max to form a completed 2-up cigarette structure 531. Thereafter, the 2-up cigarette structure 531 is severed and the cigarettes are aligned at drum 264 whereupon they are directed to a packer 266 from whence they go to a cartoner 268 and to a case packer 270.

Hollow acetate filter plugs may be produced in continuous fashion from a tubular filter rod maker such as the maker as described in U.S. Pat. No. 3,637,447 to Berger et al. Subsequent combining and tipping operations may be executed on a Molins double-action plug-tube combiner ("DATPC"). Preferably, the tobacco rods are constructed on a conventional cigarette rod making machine (such as a Molins Mark 9 tobacco rod maker) wherein cut filler (preferably blended) is air formed into a continuous rod of tobacco on a traveling belt and enwrapped with a continuous ribbon of plug wrap which is then glued along its longitudinal seam and sealed with adhesive.

The output of the tobacco rod maker is then cut and delivered to a tipping machine such as a Hauni Dual Hopper Max that has been modified to execute the combining and tipping operations described herein.

Figure 30:
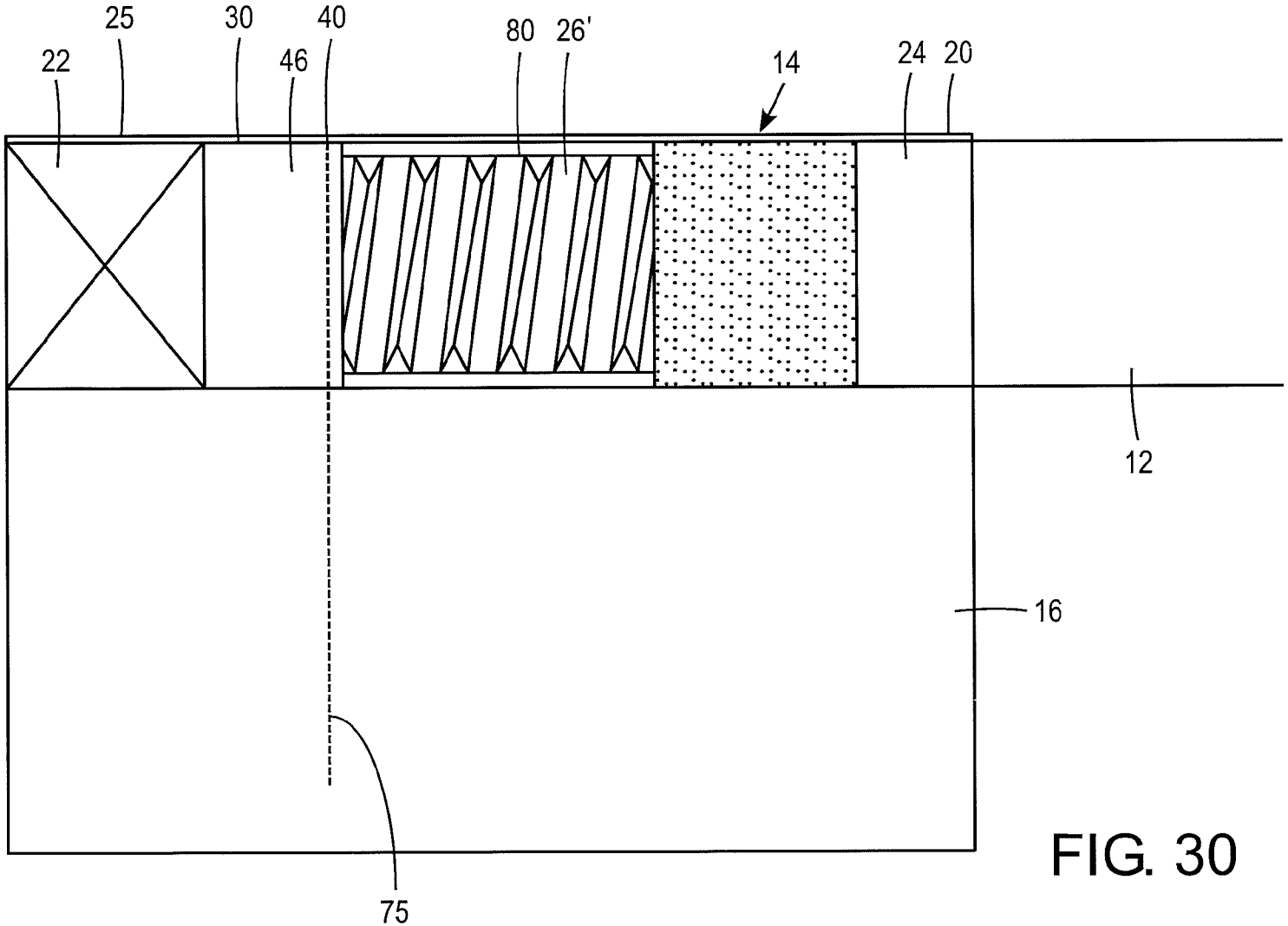
FIG. 30 is a side view of a smoking article having a flow restrictor in the form of a spiral flow segment in the a filter.

In another embodiment, as illustrated in FIG. 30, the flow restriction segment 26' includes a torturous, preferably spiral, channel 80 in filter 14 to introduce the desired resistance to draw. The spiral smoke flow pattern through the restrictor 26' can reduce gas vapor phase of mainstream smoke by diffusion, absorption/adsorption, and/or can reduce larger or heavier smoke particles by centrifugation and impaction.

Preferably, as seen in FIG. 30, a spiral flow channel 80 opens into a large central cavity 46 and is preferably located upstream of the ventilation zone 40 of the filter 14. Preferably, the channel 80 is formed in an impermeable material. Preferably, the spiral channel 80 is made of a material selected from the group consisting of high density polyethylene, compressed cellulosic materials, and combinations thereof. Regular wrapping paper, carbon paper, or carbon on tow is wrapped around the segment 26' to enclose the spiral flow path for smoke. Preferably, the spiral channel 80 has an inner diameter of about 0.30 mm to about 1.5 mm and a length of about 10 mm to about 200 mm.

In an embodiment, flavorants or colorants can be added to the material surrounding the spiral channel 80. Examples of flavorants include licorice, sugar, isosweet, cocoa, lavender, cinnamon, cardamom, apium graveolens, fenugreek, cascarilla, sandalwood, bergamot, geranium, honey essence, rose oil, vanilla, lemon oil, orange oil, mint oils, cassia, caraway, cognac, jasmine, chamomile, menthol, cassia, sage, spearmint, ginger, coriander, coffee and the like.

In this embodiment, smoke is drawn through the channel 80 during a puff and the channel 80 acts as a flow restrictor. Depending on the cross-section and length of the channel 80, a desired pressure drop across the segment can be achieved.

The channel 80 leads to a cavity 46 within the filter 14 that is defined at least in part by a tubular segment 30, such as a cellulosic tube extending from end to end of filter 14. A ventilation zone 40 is introduced downstream of the spiral channel 80. Perforations in the tipping paper 16 and the cylindrical tubular filter segment 30 provide for ventilation and the tubular segment 30 may optionally be constructed of fibers so as to be air-permeable.

The spiral flow channel 80 can be finely tuned to selectively allow only a particular range or size of smoke, for example, semi-volatile enriched smoke aerosol particles, to pass to the cavity 46. Both gas phase and particulate phase smoke can be reduced, but preferably, the flavor rich semi-volatiles are allowed to remain in the smoke. When a carbon paper or sheet material containing adsorbents is wrapped around the spiral segment, the gas phase components of the smoke being drawn through the filter channel may diffuse out or the filter and/or contact the paper longer resulting in capture of targeted constituents. The heavy or large aerosol particles experiencing centrifugation or impaction action can also be trapped. The materials, for example, paper foam or starch based plastics, used to form the segment 26' can be chosen or treated to enhance a particular filtration selectivity or to deliver flavor. For example, the material can be treated with a waxy or oil material to enhance removal of non-polar component or treated with glycerin to enhance removal of polar compounds.

Referring still to FIG. 30, the spiral flow restrictor segment could be used to remove any fine carbon particles that may have become entrained in the mainstream smoke, commonly referred to as carbon breakthrough. This functionality may be enhanced by including an agent along the wrap adjacent the spiral channel that has an affinity for the carbon particles. The agent can be a sticky or entraining substance or material such as wax, glycerin, or other carbon-catching agent.

Figure 31:
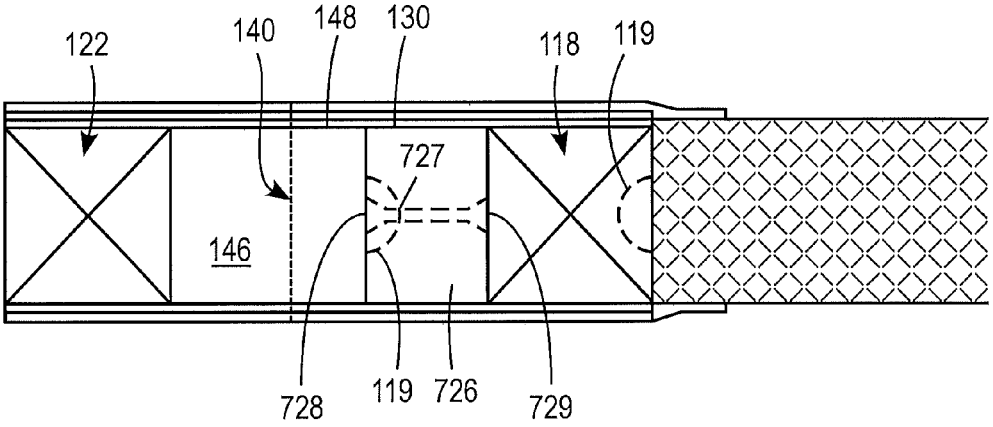
FIG. 31 is a side view of a smoking article including a preferred embodiment flow restrictor filter, wherein the filter tipping paper has been partially unfolded to reveal internal filter components.

Referring to FIG. 31, another embodiment comprises a smoking article constructed according to the same layout such as described with respect to the embodiments described in FIGS. 6 and 13-17, except for there being a restrictor segment 726 having a central channel 727 whose diameter and length are selected to impart a desired level of RTD as previously described. Preferably, the channel 727 is flared 728 at its ends 729 so as to avoid build-up of particles and condensates. Optionally, the first filter segment 118 may be provided with recesses 119, which when positioned adjacent the end 729 of the channel 727 help further abate build-up at channel 727.

Figure 32:
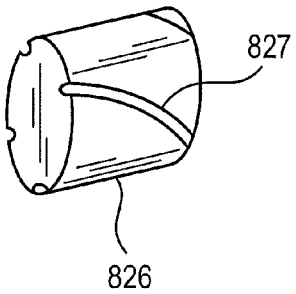
FIG. 32 is a perspective view of a flow restrictor filter segment including a plurality of spiral channels.

Referring to FIG. 32, in an embodiment, the restrictor segment 26 may include a filter plug 826 having at least one spiral groove 827 formed therein. Preferably, the at least one spiral groove 827 acts as an orifice through which smoke can pass. In this embodiment, the desired level of pressure drop (RTD) is a function of the channel 827 diameter and length of the channel 827, so the degree of spiral is adjusted to provide requisite pressure drop for a particular channel diameter.

Figure 33:
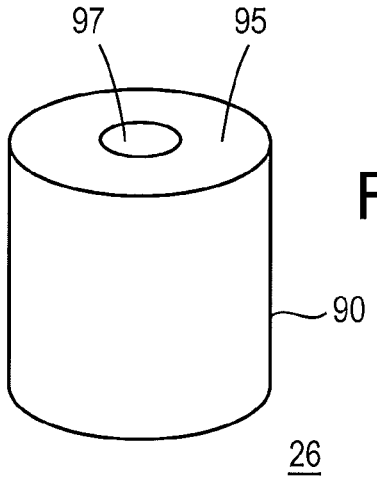
FIG. 33 is a perspective view of an alternate embodiment of a flow restrictor filter segment.
Figure 34:
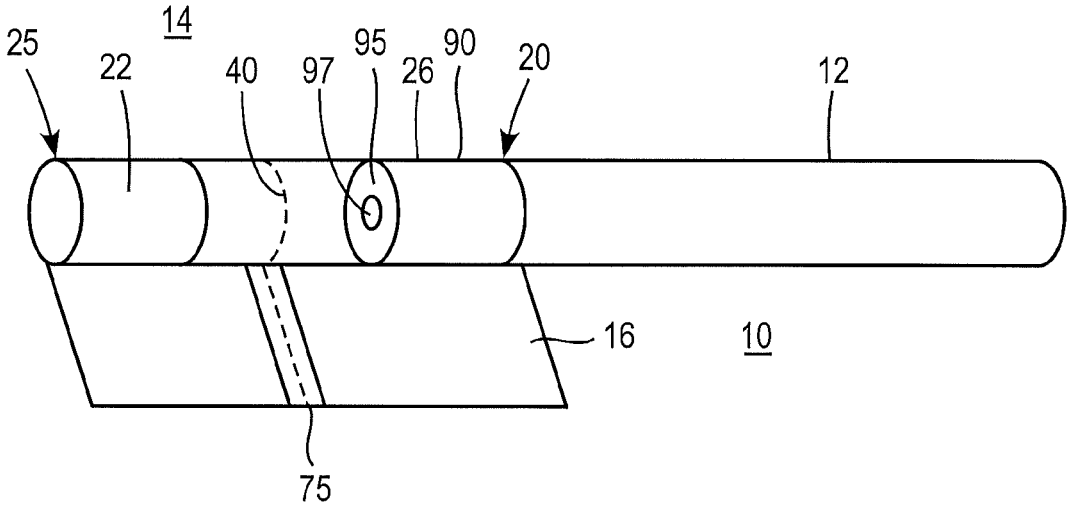
FIG. 34 is a perspective view of a smoking article including the alternate embodiment flow restrictor filter, shown in FIG. 3, wherein the filter tipping paper has been partially unfolded to reveal internal filter components.

Referring to FIGS. 33 and 34, the restrictor segment 26 may instead comprise a cellulose acetate filter plug 90 of low particulate efficiency filtering material coated or treated about an annular zone 95 on one or optionally both ends so as to define an orifice 30 at an untreated zone 97. Preferably, a small portion 97 of the end of the filter plug is left uncoated or untreated so as to form an orifice through which mainstream smoke may flow. In an embodiment, the occlusive agent is an extra amount of triacetin that is applied to one end so as to render the annular region 95 impermeable to smoke. In another embodiment, heat treatment is applied to the region 95 to render it impermeable to smoke. To avoid difficulties in high speed manufacturing, preferably the coating or treatment is not applied in an annular zone adjacent the periphery of the plug so as to allow slight compression to occur in this region of the plug when passing through a garniture or a rod-making machine and being wrapped with plug wrap. The region 95 could instead be covered with an impermeable ring of paper of film-forming agent or adhesive.

Figure 35:
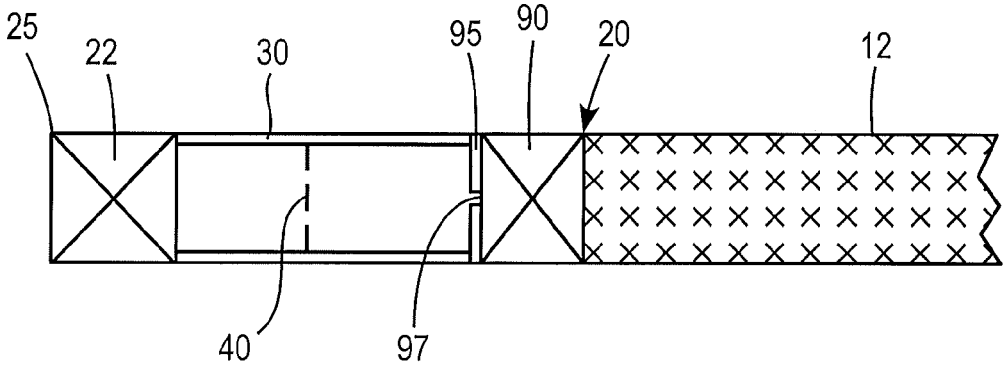
FIG. 35 is a side view of a smoking article including the alternate embodiment flow restrictor filter segment of FIG. 33, wherein the filter tipping paper has been partially unfolded to reveal internal filter components.

Referring now to FIG. 35, in a preferred embodiment, the restrictor segment 26 includes a low particulate efficiency cellulose acetate filter plug upstream of the ventilation zone 40. Preferably, the cellulose acetate filter plug 90 is coated or treated about an annular zone 95 on one end so as to define an orifice 30 at an untreated zone 97. Preferably, a small portion 97 of the end of the filter plug is left uncoated or untreated so as to form an orifice through which smoke may flow. In a preferred embodiment, when assembled, the coated end is located at a downstream of the filter segment 90. The layout of the smoking article in FIGS. 34 and 35 is arranged to perform in like manner to those of FIG. 6, and 13-17.

When manufacturing the restrictor of FIGS. 33-35, the CA plugs from Hopper 507, in FIG. 26, are cut as previously described to produce 14 mm 2-up segments, at which point, each face is treated to create orifices 97 (FIG. 33) of the restrictor 26 at opposite ends of the 14 mm 2-up segments and the operations conducted at the hopper 501 no longer need to include the T-restrictor inserts 18.

As shown in Table 2, the filter achieves significant smoke constituent reductions without the taste penalty associated by Americans with carbon-filters.

TABLE 2

| | Gas Vapor Phase (Per Tar) | | | | |
|---|---|---|---|---|---|
| FTC Smoking | | Cig. 1 | | Cig. 2 | |
| Yields (per mg Tar) | CONTROL Per Tar | Per Tar | Reduction | Per Tar | Reduction |
| CO | 1.2 | 1.3 | 6% | 0.53 | −57% |
| 1,3-Butadiene | 5.2 | 2.8 | −47% | 2.2 | −57% |
| Acetaldehyde | 68.4 | 30.7 | −55% | 35.7 | −48% |
| Acetone | 34.3 | 17.3 | −50% | 23.1 | −33% |
| Acrolein | 6.4 | 1.5 | −76% | 3.0 | −52% |

TABLE 2-continued

| | Gas Vapor Phase (Per Tar) | | | | |
|---|---|---|---|---|---|
| FTC Smoking | | Cig. 1 | | Cig. 2 | |
| Yields (per mg Tar) | CONTROL Per Tar | Per Tar | Reduction | Per Tar | Reduction |
| Acrylonitrile | 1.1 | 0.3 | −72% | 0.5 | −51% |
| Benzene | 5.2 | 1.3 | −76% | 2.9 | −45% |
| Butyraldehyde | 4.0 | 1.0 | −74% | 2.4 | −40% |
| Crotonaldehyde | 1.4 | 0.4 | −72% | 1.0 | −30% |
| Formaldehyde | 1.9 | 1.8 | −4% | 1.4 | −24% |
| Isoprene | 49.3 | 16.4 | −67% | 22.5 | −54% |
| Propionaldehyde | 5.2 | 1.5 | −71% | 2.8 | −47% |
| Styrene | 0.6 | 0.1 | −87% | 0.4 | −25% |
| Toluene | 8.3 | 1.6 | −80% | 4.8 | −42% |

Control Cig.: Low FTC tar commercial cigarette (6 mg FTC tar)
Cig. 1: Same as Control cigarette but with addition of 45 mg activated carbon in the filter (6 mg FTC tar)
Cig. 2: Restrictor filter prototype cigarette (6 mg FTC tar) as shown in FIG. 13

It will be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. For example, various filters are described as being constructed of cellulose acetate tow, whereas other materials, such as filter paper, carbon paper, polypropylene, and other similar materials could be used instead. Accordingly, the exemplary embodiments, as well as alternative embodiments, may be made without departing from the spirit and scope of the articles and methods as set forth in the attached claims.

We claim:

1. A cigarette filter comprising:

a restrictor element in a set position within a self-sustaining paper tube, the restrictor element comprising a tubular segment having a transverse wall located between upstream and downstream ends of the tubular segment such that the tubular segment has end to end symmetry surrounding the transverse wall; and a ventilation zone communicating with a cavity defined within said paper tube, the ventilation zone being downstream of the transverse wall and comprising a plurality of perforations extending through the self-sustaining paper tube wherein the restrictor element has beveled upstream and downstream edges.

2. A cigarette filter comprising:

a restrictor element in a set position within a self-sustaining paper tube, the restrictor element comprising a tubular segment having a transverse wall located between upstream and downstream ends of the tubular segment; and a ventilation zone communicating with a cavity defined within the paper tube and comprising a plurality of perforations extending through the self-sustaining paper tube;

wherein said restrictor element is adapted to produce a predetermined pressure drop;

said ventilation zone is in a downstream relation to said restrictor element; and when a smoking article comprising the cigarette filter is smoked, the ventilation zone provides substantially uniform ventilation over at least 50% of a puff count smoking cycle.

3. A smoking article comprising a tobacco rod and a filter, said filter as set forth in claim 1.

4. The smoking article of claim 3, wherein the restrictor element provides a resistance to draw of at least 40 mm water and the ventilation provides substantially uniform ventilation over at least 50% of a puff count smoking cycle and/or the restrictor element is an injection molded insert which includes the transverse wall and the tubular segment, wherein the transverse wall is an impermeable transverse wall with at least one orifice therein.

5. A smoking article comprising:

a tobacco rod adapted to produce mainstream smoke;

a filter attached to the tobacco rod by tipping paper, the filter having an upstream end adjacent the tobacco rod, a filter plug of low filtration efficiency cellulose acetate at a downstream end thereof, a restrictor element defining at least one flow passage therethrough upstream of the filter plug, the restrictor element comprising a tubular segment having a transverse wall located between upstream and downstream ends of the tubular segment such that the tubular segment has end to end symmetry surrounding the transverse wall, the restrictor element being located at a set position within a self-sustaining, spiral wound paper tube, an empty cavity extending between an upstream end of the filter plug and a downstream end of the restrictor element, the at least one flow passage being spaced a distance from the upstream end of the filter plug which minimizes impaction of particulate phase of the mainstream smoke on the upstream end of the filter plug, and a ventilation zone comprising a plurality of perforations extending through the tipping paper and the self-sustaining, spiral wound paper tube, and communicating with the cavity;

wherein the at least one passage providing a resistance to draw of at least 70 mm water and the ventilation zone providing at least 70% dilution to the mainstream smoke wherein the restrictor element has beveled upstream and downstream edges.

6. The cigarette filter of claim 1, wherein the paper tube is a spiral wound paper tube.

7. The cigarette filter of claim 2, wherein the paper tube is a spiral wound paper tube.

* * * * *